US006931885B2

(12) United States Patent
Citrynell et al.

(10) Patent No.: US 6,931,885 B2
(45) Date of Patent: Aug. 23, 2005

(54) DRINKING VESSELS WITH REMOVABLE COOLING DEVICES

(75) Inventors: Andrew Citrynell, 264 Sunrise La., Carbondale, CO (US) 81623; Kimberly Ann Miller, Carbondale, CO (US); Joel Schwarze, Hutchinson, MN (US)

(73) Assignee: Andrew Citrynell, Carbondale, CO (US)

( * ) Notice: Subject to any disclaimer, the term of this patent is extended or adjusted under 35 U.S.C. 154(b) by 0 days.

(21) Appl. No.: 10/712,170

(22) Filed: Nov. 12, 2003

(65) Prior Publication Data

US 2004/0177642 A1 Sep. 16, 2004

Related U.S. Application Data

(63) Continuation-in-part of application No. 10/389,733, filed on Mar. 14, 2003, now Pat. No. 6,758,058.

(51) Int. Cl.[7] ..... F25D 3/08
(52) U.S. Cl. ..... 62/457.3; 62/530
(58) Field of Search ..... 62/457.3, 457.4, 62/457.1, 530, 371, 438, 529; 220/709, 739

(56) References Cited

U.S. PATENT DOCUMENTS

| | | | |
|---|---|---|---|
| 4,765,393 | A | 8/1988 | Baxter |
| 5,044,173 | A | 9/1991 | Cheng |
| 5,189,892 | A | 3/1993 | Roberts |
| 5,467,877 | A | 11/1995 | Smith |
| 5,597,087 | A | 1/1997 | Vinarsky |
| 6,474,096 | B1 | 11/2002 | de la Guardia |

*Primary Examiner*—Chen Wen Jiang
(74) *Attorney, Agent, or Firm*—Townsend and Townsend and Crew LLP

(57) ABSTRACT

In one embodiment, a beverage container comprises a vessel having an interior that is adapted to hold a beverage. The vessel has a closed bottom end and an open top end. The bottom end defines a cavity that is fluidly sealed from the interior of the vessel. A cooling element is configured to be coupled to the vessel and to fit within the cavity. A base comprises a bottom member and a stem extending vertically upward from the bottom member. The base includes a connector that is configured to be coupled to the cooling element or vice versa.

19 Claims, 24 Drawing Sheets

DRINKING VESSELS WITH REMOVABLE COOLING DEVICES

CROSS REFERENCES TO RELATED APPLICATIONS

This invention is a continuation in part application and claims the benefit of U.S. application Ser. No. 10/389,733, filed Mar. 14, 2003, now U.S. Pat. No. 6,758,058 the complete disclosure of which is herein incorporated by reference.

BACKGROUND OF THE INVENTION

This invention relates generally to the filed of cooling beverages, and in particular to the use of removable cooling elements that may be integrated into various beverage containers. Such cooling elements are removable to permit them to be placed into a refrigerator freezer and reused.

One common method to cool beverages is with ice cubes. Another way to frost a glass in a freezer. However, there are many problems associated with these methods. For example, ice cubes dilute the beverage and can alter the taste of the beverage. Ice cubes may also be contaminated when touched by a human hand, such as when placing them into the beverage. As another example, when frosting a glass in the freezer, the frost can be contaminated by other products in the freezer, causing an odor. As a further example, the beverage may be contaminated by the water used to make the ice.

Hence, this invention is related to devices and techniques for cooling beverages which greatly reduces or eliminates such drawbacks.

BRIEF SUMMARY OF THE INVENTION

In one embodiment, the invention provides a beverage container that comprises a vessel having an interior for holding a beverage. The vessel has a closed bottom end and an open top end, with the bottom end defining a cavity that is fluidly sealed from the interior of the vessel. The beverage container also includes a cooling element that is configured to fit within the cavity. The beverage container further includes a base comprising a bottom member and a stem extending vertically upward from the bottom member. The base includes a connector that is configured to be coupled to the bottom end of the vessel and to enclose the cooling element within the cavity. In this way, a beverage held within the vessel may be cooled by the cooling element that is fluidly sealed from the interior of the vessel. As such, the beverage may be cooled without contamination from the cooling element. Further, the cooling element may easily be removed and replaced with a fresh cooling element whenever needed.

In one aspect, the connector comprises a threaded end on the stem. The cavity may also include a threaded section so that the threaded end may be screwed up into the cavity using the threaded section. In this way, the exterior of the beverage container may contain a smooth morphology to make the container more aesthetically pleasing. At the same time the beverage container may easily be separated into its component parts for cleaning, replacement of the cooling element, or the like. As an alternative, the stem may include a female section to mate with a corresponding male section.

In another aspect, the cavity may be generally cylindrical in geometry and extend vertically upward into the interior of the vessel. With such a configuration, the cooling element may comprise a cylinder that is filled with a cooling substance. Other shapes include cubed, hemispherical, curved, and the like. In a further aspect, both the connector and the vessel may be constructed of various materials, such as glass, hard plastics, glass coated with a hard plastic, crystal, ceramic, acrylic and the like.

The beverage containers of the invention may be configured into a wide variety of shapes while still providing a suitable cooling element. For example, the vessel may be in the shape of a mug, a wine glass, a martini glass, a tumbler, a stein glass, a margarita glass, a champagne glass, ordinary drinking glasses (such as water glasses), beer glasses, including pint glasses, and the like. In some embodiments, the beverage containers may be reinforced at the juncture of the cavity and the exterior of the vessel to prevent the vessel from premature breakage.

In one particular embodiment, the bottom end of the vessel may define a generally hemispherical cavity that is fluidly sealed from the interior of the vessel. With such configuration, a generally hemispherical cooling element may be provided to fit within the cavity. In this way, the base may be coupled to the bottom end of the vessel to enclose the cooling element within the cavity. The use of a generally hemispherical cooling element is advantageous in that it maximizes the surface area available for heat transfer. Such a cooling element is also particularly useful in beverage containers that have the shape of a tumbler, mug, or the like because the generally hemispherical cavity fits nicely within the interior of the vessel. Conveniently, the vessel may include threads while the bottom end of the base also includes threads to permit the base to be screwed into the vessel. The threads on the base may be either male or female to correspond with female or male threads on the vessel.

The angle of the threads may be in the range from about 45 degrees to about 90 degrees, in some cases from about 65 degrees to about 75 degrees, and in some case about 70 degrees.

To connect or disconnected the two parts, they may be twisted relative to each other by about ¼ to about one turn, and more preferably from about ¼ to about ½ turn.

Another feature of the invention is that it may include one or more trays having a plurality of holding regions for holding the cooling element. In this way, the tray may be placed into a freezer to simultaneously cool multiple elements.

In one aspect, the tray may include a plurality of recesses that are integrally formed in the tray to define the holding regions. The recesses may be in the shape of the cooling element so that they may easily fit within the recesses. For example, the recesses may be semi-cylindrical, hemispherical, pyramid shaped, cube shaped and the like.

In another embodiment, the invention provides a beverage container that comprises a vessel having an interior for holding a beverage. The vessel has a closed bottom end and an open top end, and the bottom end defines a cavity that is fluidly sealed from the interior of the vessel. A cooling element is configured to be coupled to the vessel and to fit within the cavity. The container also includes a base that comprises a bottom member and a stem extending vertically upward from the bottom member. The base includes a connector that is configured to be coupled to the cooling element. In this way, the cooling element sits between the vessel and the base to connect the two elements. In this way, the cooling element may be constructed of a material that may interface with glass or another fragile material that is used to construct the vessel and the base. The base, vessel and cooling element may be connected to each other by a snap fit, by screwing, by a lock twist and the like. Such connectors may include male and female components that can be used on any of the interconnecting parts.

In one aspect, the connector may comprise a male threaded end on the stem, and the cooling element may include a female threaded section. The male threaded end on the stem is configured to be screwed into the female threaded section of the cooling element. Further, the threads on the female threaded section of the cooling element may have an angle in the range from about 65 degrees to about 75 degrees, and more preferably about 70 degrees. This permits the base to be coupled to the cooling element with a single twist (about a half a turn). The cooling element may also include a male threaded section, and the vessel may include a female threaded section at the bottom end. The male threaded section of the cooling element is configured to be screwed into the female threaded section of the vessel. The male threaded section of the cooling element may have threads with an angle in the range from about 45 degrees to about 90 degrees, in some cases from about 65 degrees to about 75 degrees, and in some case about 70 degrees.

In another aspect, the base and the vessel are constructed of glass, and the cooling element is constructed of a material that is different from glass, such as an acrylic. The acrylic may have a durometer of about 30 to about 40, and more preferably about 35. This material provides a stable connection while still being soft enough to be coupled to the glass base and vessel. The material used may also be resistant to expanding and contracting when heated or cooled, such as when the container (or any of the components) are placed in the freezer or refrigerator or the dishwasher. In some cases, the glasses may be partially of completely made of a disposable platic.

DETAILED DESCRIPTION OF THE INVENTION

Figure 1:
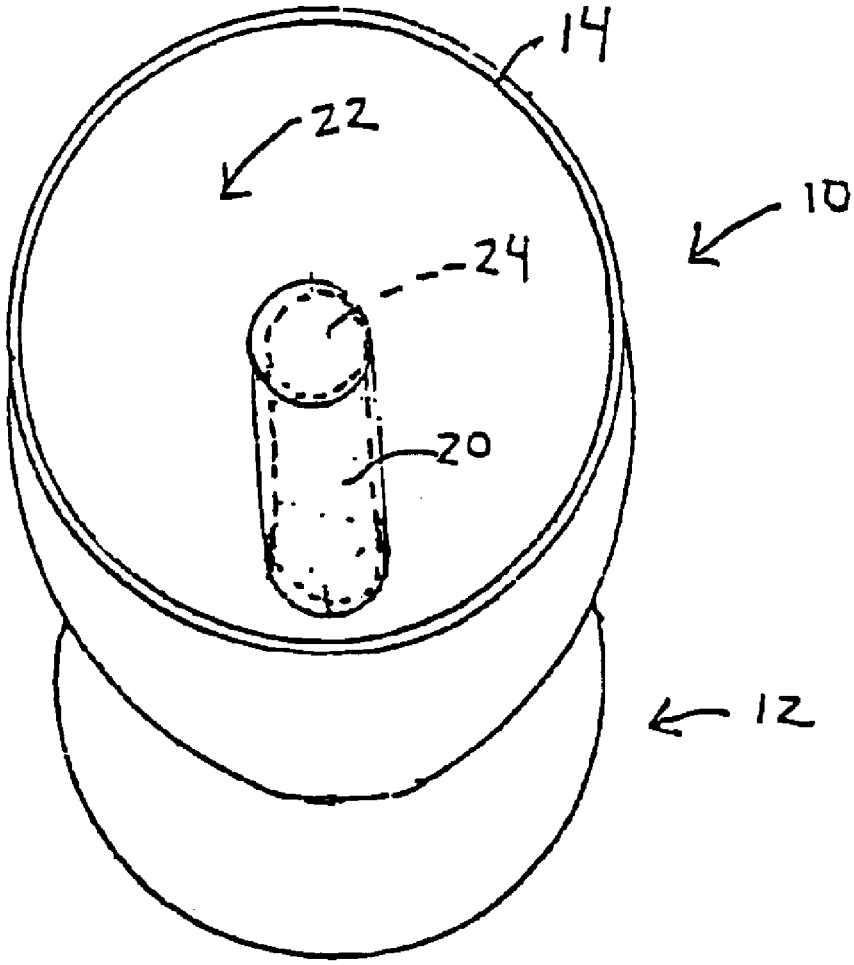
FIG. 1 is a perspective view of one embodiment of a beverage container according to the invention.
Figure 2:
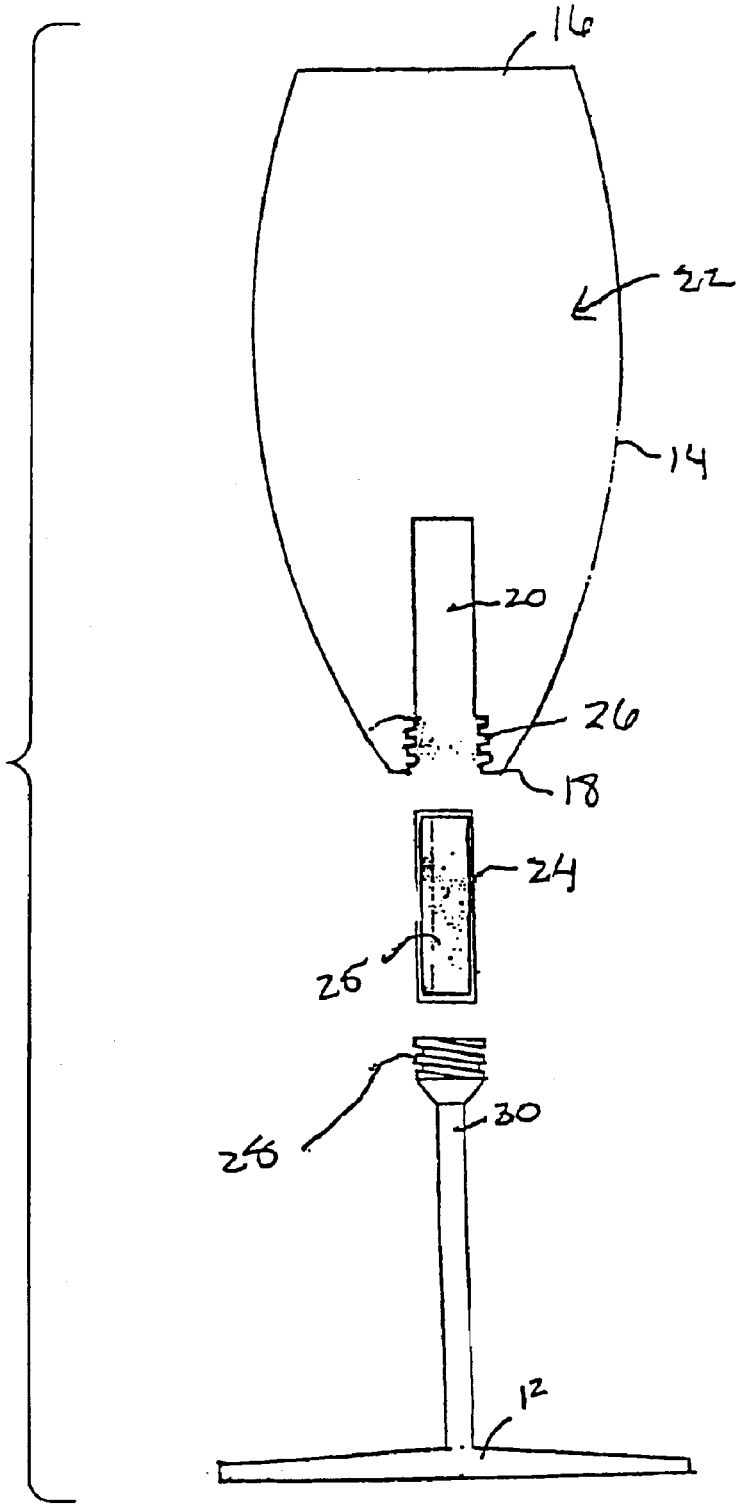
FIG. 2 is an exploded side view of the container of FIG. 1.

The invention provides various beverage containers that may be used with removable and reusable cooling elements. The containers each include a vessel for holding the liquid and a cavity for holding the cooling element. The cavity is sealed from the interior of the vessel but also extends up into the vessel to provide a cooling effect. The cavity may have a variety of shapes or styles configured to maximize heat transfer away from the liquid or to give an aesthetically pleasing appearance. Such shapes may include cylindrical, hemispherical, pyramid shaped, arcuate, square, triangular, ice cube shaped and the like. The cavity may conveniently have a shape that is similar to the cooling element, although that is not necessary. The wall thickness may also be minimized to maximize heat transfer. The cooling element may contain any substance that can be cooled and serve to absorb heat. Examples include water, gels, Blue Ice® coolant, any non-toxic re-freezable substance, and the like. Alternatively, the cooling element may be a solid substance, such as a metal rod, a piece of ice, or the like. On one alternative, the cooling element may be constructed of a glow-in-the-dark material. The cooling element may be held in the cavity by a base that has one or more connectors to connect the base to the vessel. Examples of connectors include threads, clips, snaps, screws, press fits and the like. The base may be screwed, twisted, locked or snapped into place. One advantage of using threads is that the vessel may be coupled to the base utilizing relatively few threads. In this way, the two components may be locked together using a single twist. The components may be coupled by a ¼ turn all the way to a full turn, or even greater. Further, such threads permit the two components to be easily unscrewed, even when the vessel is filled with liquid so that the cooling element may easily be replaced. Few threads also reduce the changes of having the vessel or the base break. Further, with few threads, the beverage container remains symmetrical when assembled, while still being easy to fit together. This configuration also facilitates the speed at which the container may be assembled and disassembled, and facilitates ease of use.

Hence, the invention provides a removable cooling element for cooling beverages that may be placed into a regular refrigerator freezer between uses. The removable device when frozen may be placed into an upper portion of the vessel, and a bottom portion may then be attached to the upper portion. The device easily fits into the vessel, which may be constructed of a wide variety of materials, such as glass, plastic or the like. The base of the beverage container may be tubular, cubical, semicircular, pyramidal, or the like, and may be connected to the bottom of the vessel by a stem or end portion that attaches to the bottom of the vessel and seals in the cooling element. When threads are used, they may be constructed of a hard plastic, acrylic or the like, or glass with a hard plastic or acrylic coating. As another example, one of the threaded elements may be a hard plastic while the other is made of glass, or both may be of a hard plastic. The vessels may be made of glass, plastic, acrylic, ceramic, crystal, earthen ware, a disposable plastic, or the like. As one specific example, the male threading may be on the base or stem and may be constructed from a hard plastic, acrylic or glass with a hard plastic or acrylic coating on a glass stem. Alternatively, female threads could be used as well. Such materials serve to seal the cooling device into the integrated vessel and base to cool the beverage without ever contacting it. As such, the cooling device may be replaced even while the fluid is in the vessel to provide additional cooling.

In one aspect, the bottom end of the cooling element may include a slot so that a tool may be used to turn the cooling element in case it gets lodged into the vessel. The slot may be sized to receive a coin (such as a quarter or a dime), a screwdriver or the like.

Alternatively, both the base and the vessel may be coupled to the cooling element. In this way, the cooling element serves as a connector to connect the base to the vessel without coming into contact with each other. This arrangement permits the base and the vessel to be constructed of a fragile material, such as glass, and still be coupled to each other. Further, this arrangement permits the cooling element to easily be removed and placed in a cooler to cool the cooling element.

The cooling element may also be made of a hard plastic or acrylic, and the re-freezable substance may be of any color. In some cases, the cooling element could be made of a fluorescent or a glow in the dark material or any other easily identifiable material. Similarly, the vessel may also be of any color.

When the cooling device is removed, it may be washed and then kept in the freezer in an appropriate cooling tray or bucket. The tray may have regions that are shaped to hold the particular cooling element. Because the removable cooling element is never in contact with the interior of the vessel, it is always hygienic.

Such a system provides a variety of advantages. For example, as just described, the beverage is hygienically cooled using a reusable cooling device that never contacts the beverage. The cooling elements fit neatly into a tray and take up little room in the freezer, usually less than an ordinary ice tray.

Further, the beverage container may be separated into parts to facilitate washing. For example, the stem may be separated from the vessel and separately placed into a dishwashing machine with a reduced risk of being broken.

The beverage container or insert may also come in an assortment of colors to make identification of the container simple, thus resulting in less chance of the spreading of germs by drinking from another's glass. Different colors may also be used for the cooling element, the fluid within the cooling element and the cavity used to hold the cooling element, including fluorescent or glow in the dark materials.

Another feature is that the extension into the interior of the vessel takes up extra volume. In this way, restaurants and bars may increase their profits per drink.

The beverage also does not get diluted with melting ice, and there is no contamination from the ice/odors or impurities in the water. This is also true with frosted glasses, where the frost can have odors or contamination from the water used to make frost.

Also, since no ice cubes are placed into the beverage, there is no chance of contamination from a person's hand used to place the ice into the beverage. In fact, no human contact with the beverage is ever experienced.

Referring now to FIG. 1, one embodiment of a beverage container 10 will be described. Container 10 comprises a base 12 and a vessel 14 having an open top end 16 and a closed bottom end 18. Formed in bottom end 18 is a cavity 20 that extends up into the interior 22 of vessel 14. Cavity 20 is cylindrical in geometry and is sized to receive a cylindrical cooling element 24. The bottom of cavity 20 has threads 26 for receiving a threaded end 28 of a stem 30 that is part of base 12. In this way, cooling element 24 containing a cooling substance 25 may be inserted into cavity 20, and threaded end 28 of stem 30 may be screwed into threads 26 to completely seal cooling element 24 within cavity 20. One advantage of using internal threads within cavity 20 is that a continuous smooth surface is provided at the interface between vessel 14 and stem 30. As such, container 10 has the appearance of a traditional wine glass, except for the presence of cooling element 24 that extends into interior 22. However, this has the advantage of reducing the volume of interior 22 so that restaurants and bars can reduce the amount of beverages served while still charging the same amount.

Another advantage is that the cooling element 24 is almost entirely exposed to interior 22 to maximize heat transfer. Further, since cooling element 24 is sealed from the beverage, no contamination of the beverage by a coolant occurs. Container 10 is also aesthetically pleasing and can be fashioned in essentially any shape or configuration, including conventional shapes and designs as described hereinafter.

In use, cooling element 24 is placed into a cold location, such as a refrigerator or freezer. When ready to pour a beverage, cooling element 24 is removed and placed into cavity 20. Threaded end 28 is then screwed into cavity 20 until it is unable to turn and a smooth surface at the joint is formed. A beverage is then poured into vessel 14 where it is cooled by cooling element 24. At any time, base 12 may be unscrewed and cooling element 24 replaced with another one.

Figure 3:
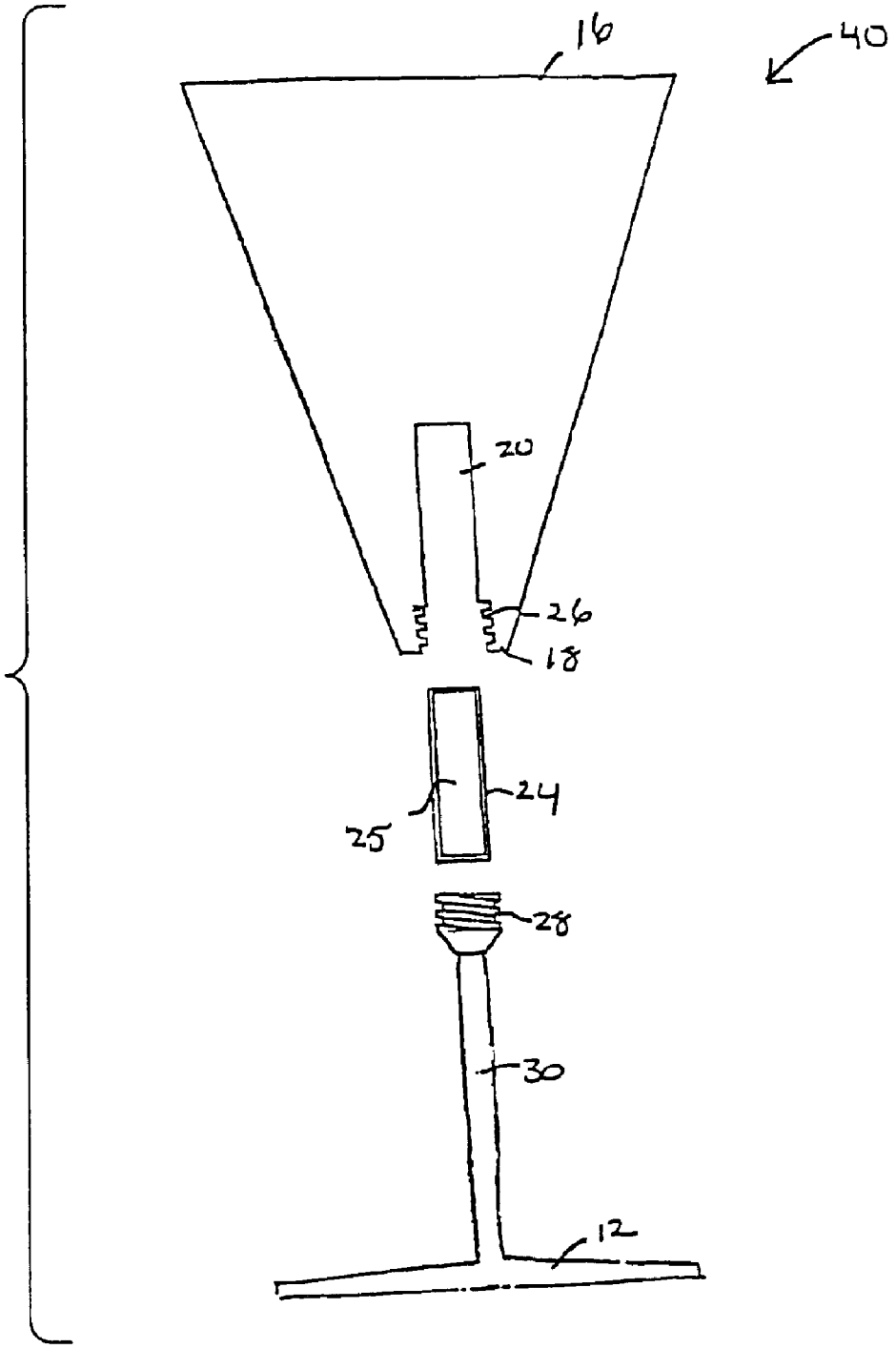
FIG. 3 is an exploded side view of another embodiment of a container according to the invention.

Referring now to FIG. 3 another embodiment of a beverage container 40 will be described. Container 40 is essentially identical to container 10 except that container 40 is a martini glass and has a different shaped vessel 42. As such, container 40 is labeled with the same reference numerals for elements that are the same as those used with container 10. When stem 30 is screwed into cavity 20, vessel 42 has a conical shape that is continuous at the interface between vessel 42 and stem 30.

Figure 4:
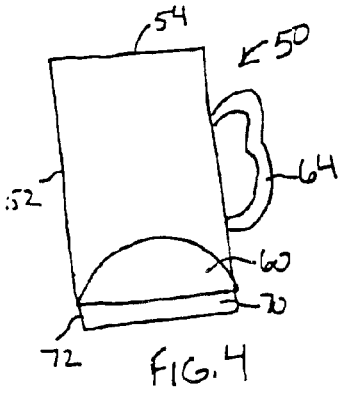
FIG. 4 is a side view of another embodiment of a container according to the invention.
Figure 4A:
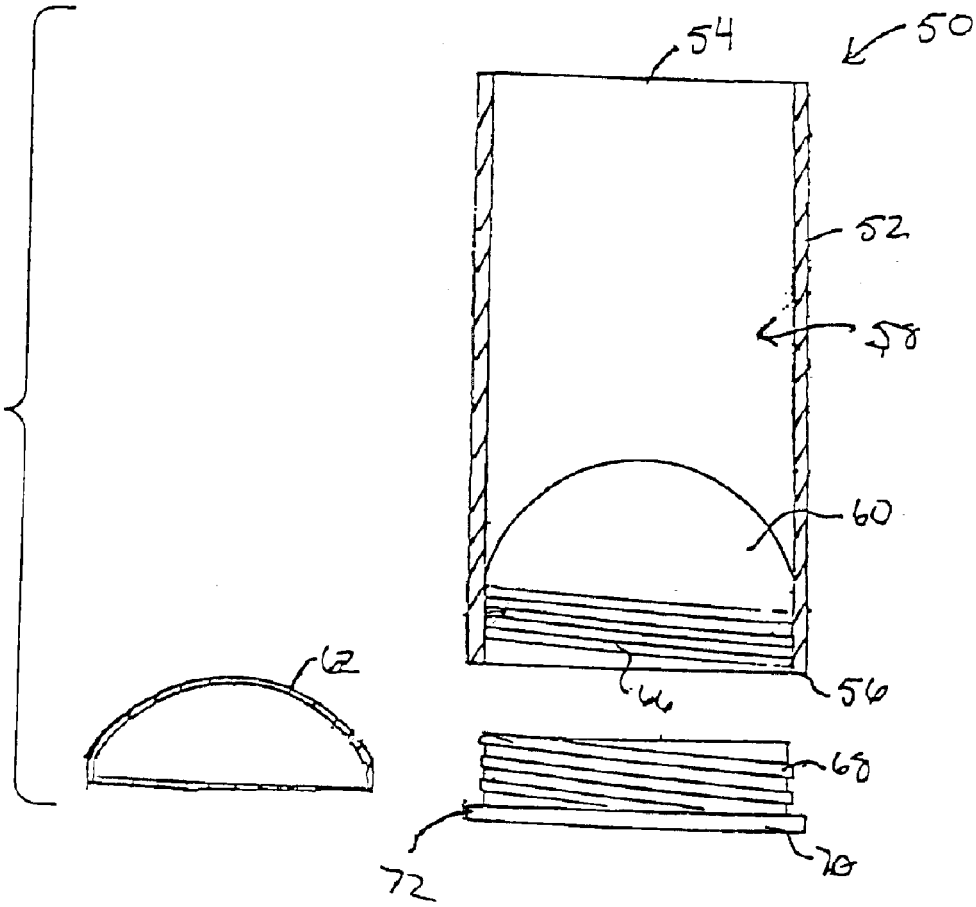
FIG. 4A is an exploded cross sectional side view of the container of FIG. 4.

FIGS. 4 and 4A illustrate a beverage container 50 in the shape of a mug. Container 50 comprises a vessel 52 having an open top 54 and a closed bottom 56 to form an interior 58. Extending up onto the interior 58 is a hemispherical cavity 60 to hold a hemispherical cooling element 62. This shape maximizes the coolable surface wherein interior 58 to maximize cooling. Conveniently, a handle 64 may be coupled to vessel 52.

Bottom 56 includes internal threads 66 to mate with threads 68 on a base 70 having an outer edge 72. After cooling element 62 is placed into interior 58, base 70 is screwed into bottom 56 until edge 72 is flush with vessel 52 as shown in FIG. 4. Hence, container 50 has the shape of a traditional mug while also containing a cooling element that is configured to maximize heat transfer. In addition, container 50 includes all of the benefits of the other containers described herein.

Figure 11:
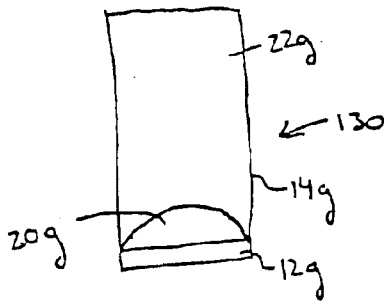
FIG. 11 is a side view of still a further embodiment of a beverage container according to the invention.
Figure 5:
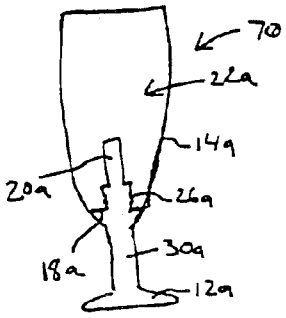
FIG. 5 is a side view of still another embodiment of a beverage container according to the invention.
Figure 6:
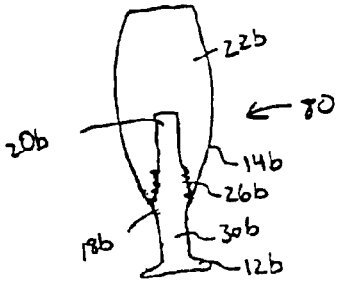
FIG. 6 is a side view of yet another embodiment of a beverage container according to the invention.
Figure 7:
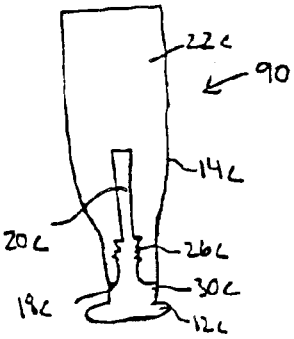
FIG. 7 is a side view of one particular embodiment of a beverage container according to the invention.
Figure 8:
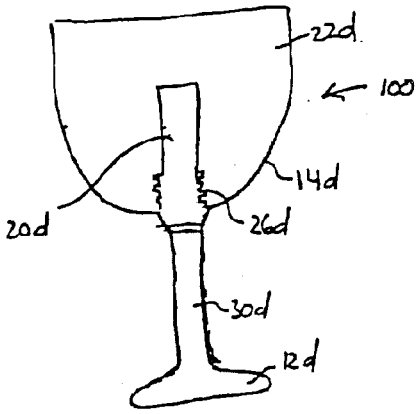
FIG. 8 is a side view of another embodiment of a beverage container according to the invention.
Figure 9:
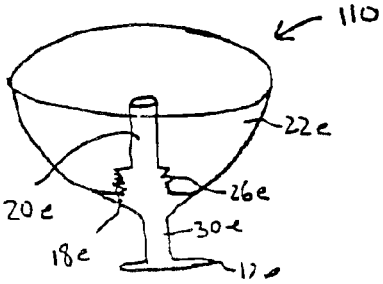
FIG. 9 is a side view of a further embodiment of a beverage container according to the invention.
Figure 10:
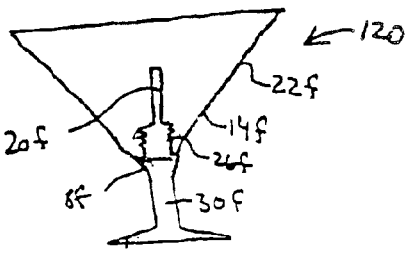
FIG. 10 is a side view of yet a further embodiment of a beverage container according to the invention.

FIGS. 5–10 describe various other embodiments of beverage containers that are constructed in a manner similar to the other containers described herein. As such, the containers in FIGS. 5–10 are labeled with similar elements followed by "a" through "g". FIG. 5 illustrates a white wine glass 70, and FIG. 6 illustrates a champagne glass 80. FIG. 7 illustrates a Stein glass 90, and FIG. 8 illustrates another wine glass 100. FIG. 9 illustrates a margarita glass 110, and FIG. 10 illustrates another martini glass 120. FIG. 11 illustrates a tumbler 130 that is similar to mug 50 of FIG. 4 without a handle. Other types of glasses include red wine glasses, brandy snifter glasses, along with essentially any other type of glass or beverage container.

Figure 12:
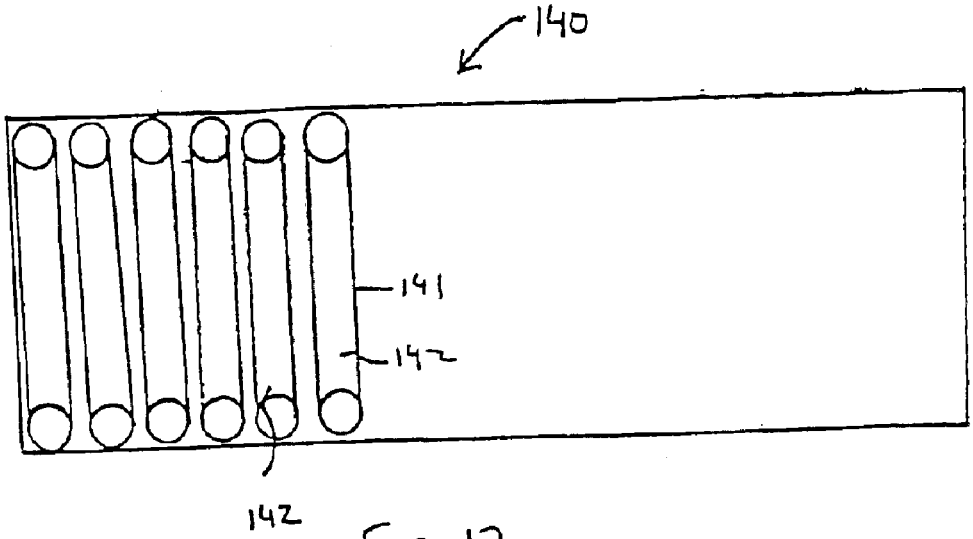
FIG. 12 is a top view of one embodiment of a tray for holding cooling elements according to the invention.

FIG. 12 illustrates one embodiment of a tray 140 having a plurality of recessed regions 141 that may be semi-cylindrical in geometry for holding a set of cylindrical cooling elements 142. In this way, multiple cooling elements 142 may simultaneously be placed into a freezer while using minimal space. When a beverage container needs a new cooling element, it may simply be removed from tray 140 and placed into the cavity as previously described. The old cooling element may then be placed onto tray 140 which is placed into the freezer. Further, it will be appreciated that tray 140 may have any shape of indentation needed to match the shape of the cooling element, including any of the shapes described herein.

Figure 13:
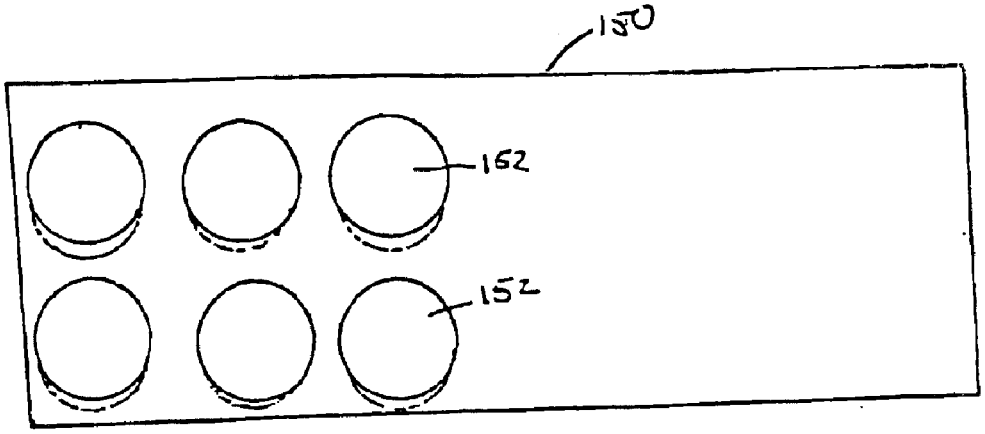
FIG. 13 is a top view of another embodiment of a tray for holding cooling elements according to the invention.

FIG. 13 illustrates an alternative tray 150 having a plurality of hemispherical recesses 152 for receiving hemispherical cooling elements. Tray 150 may be used in a manner similar to tray 140.

Although some embodiments are described in the context of a martini glass, it will be appreciated that similar techniques may be used for any of the other beverage containers described herein. For example, tumbler 50 could be modified so that cooling element 62 included internal and external threads in a manner similar to connector 214.

Figure 14:
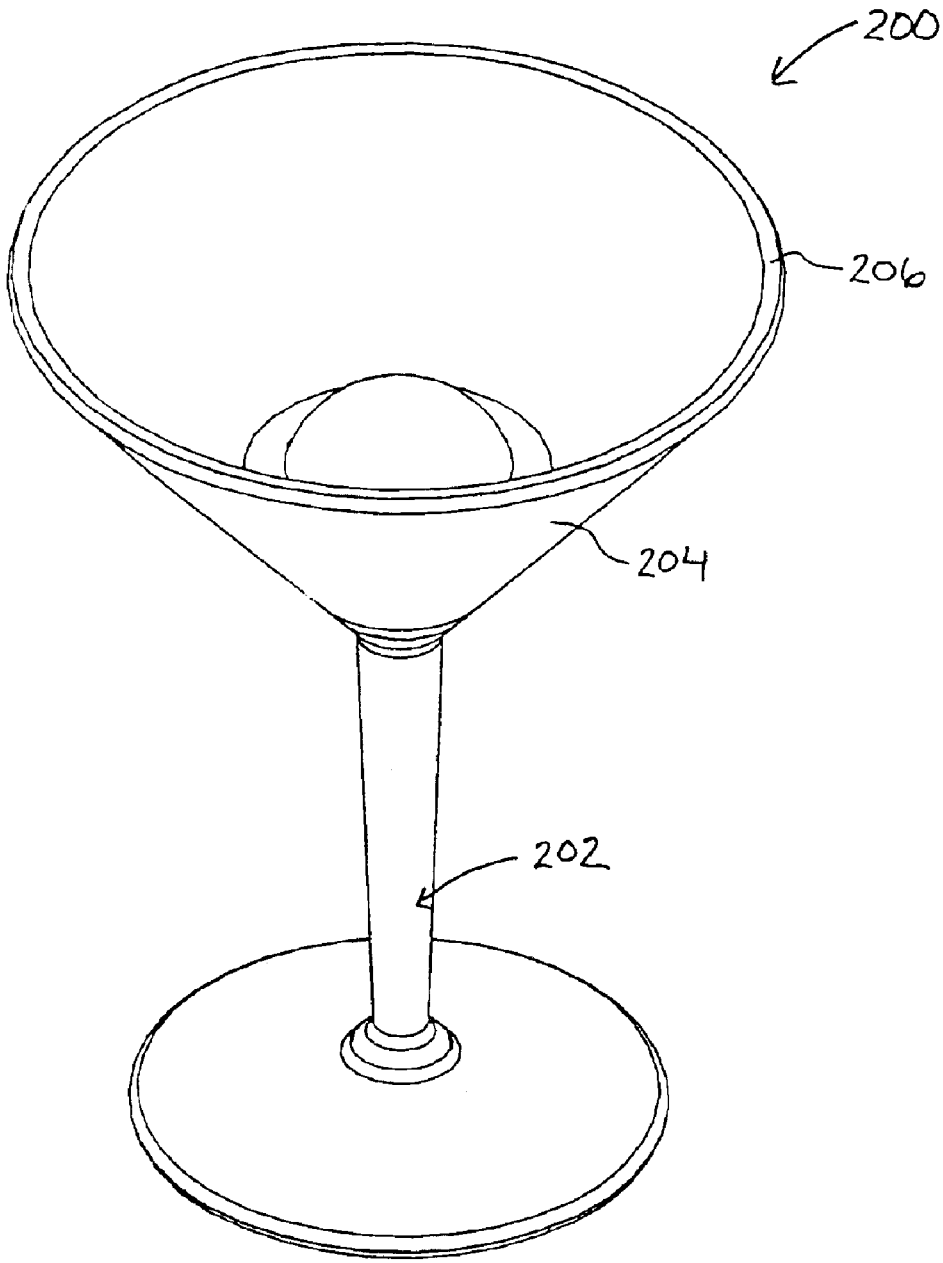
FIG. 14 is a perspective view of another embodiment of a beverage container according to the invention.
Figure 15:
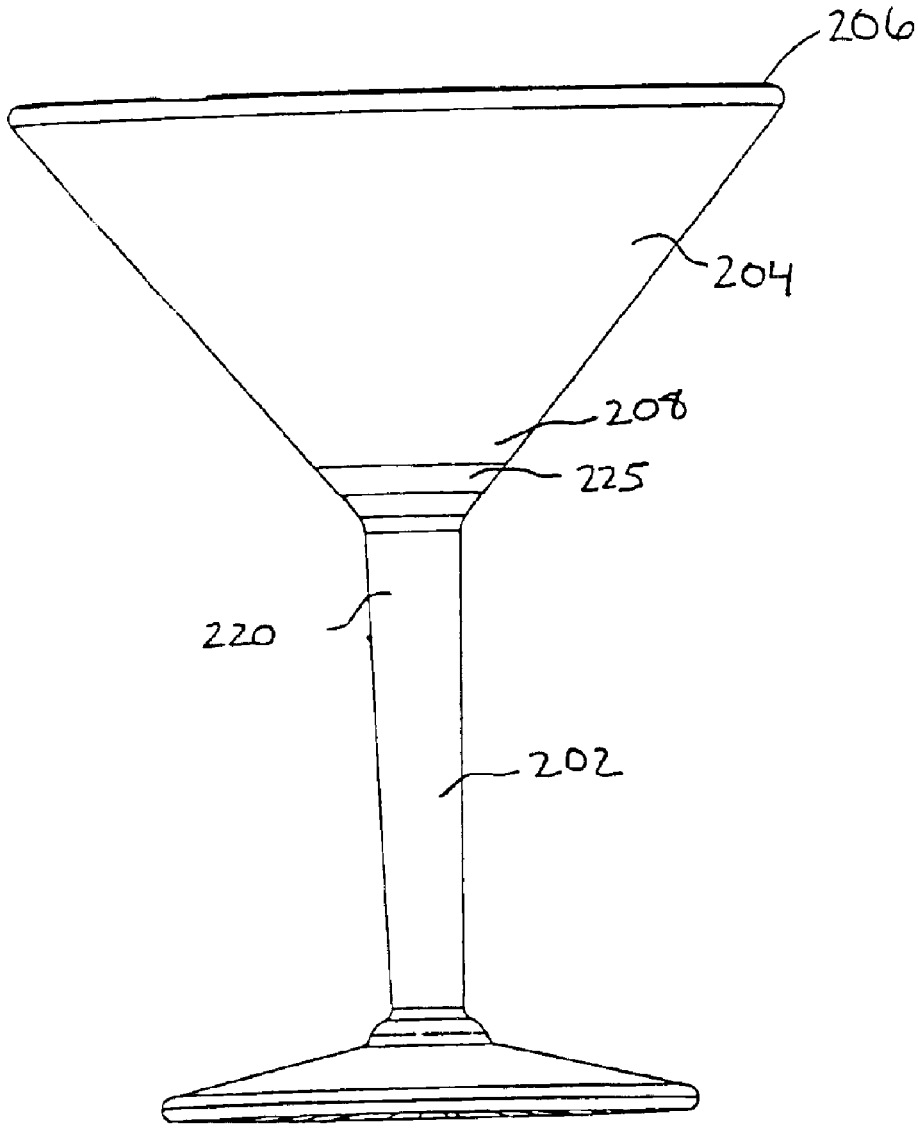
FIG. 15 is a front view of the container of FIG. 14.
Figure 16:
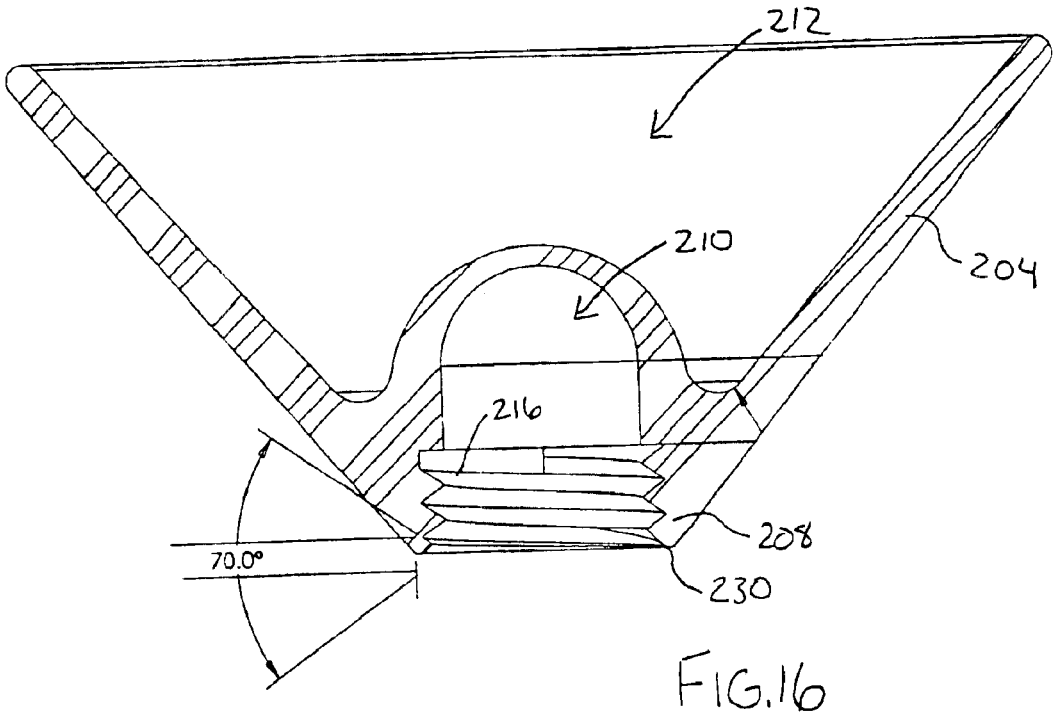
FIG. 16 is a cross sectional view of a vessel of the container of FIG. 15.
Figure 17:
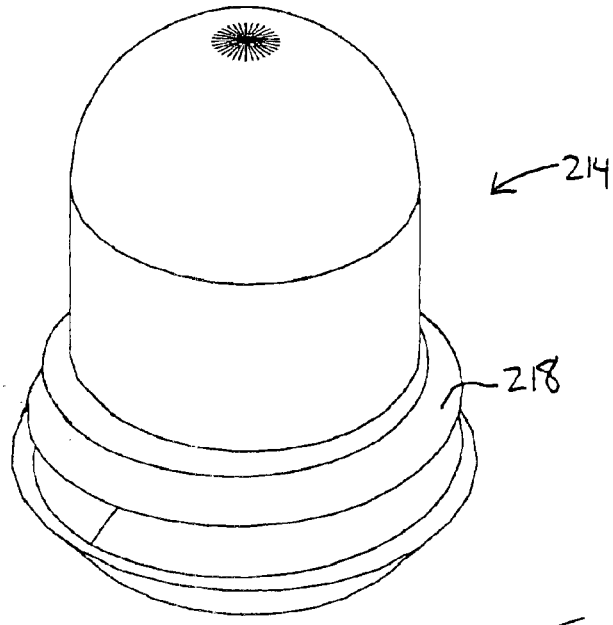
FIG. 17 is a perspective view of a cooling element of the container of FIG. 14.
Figure 18:
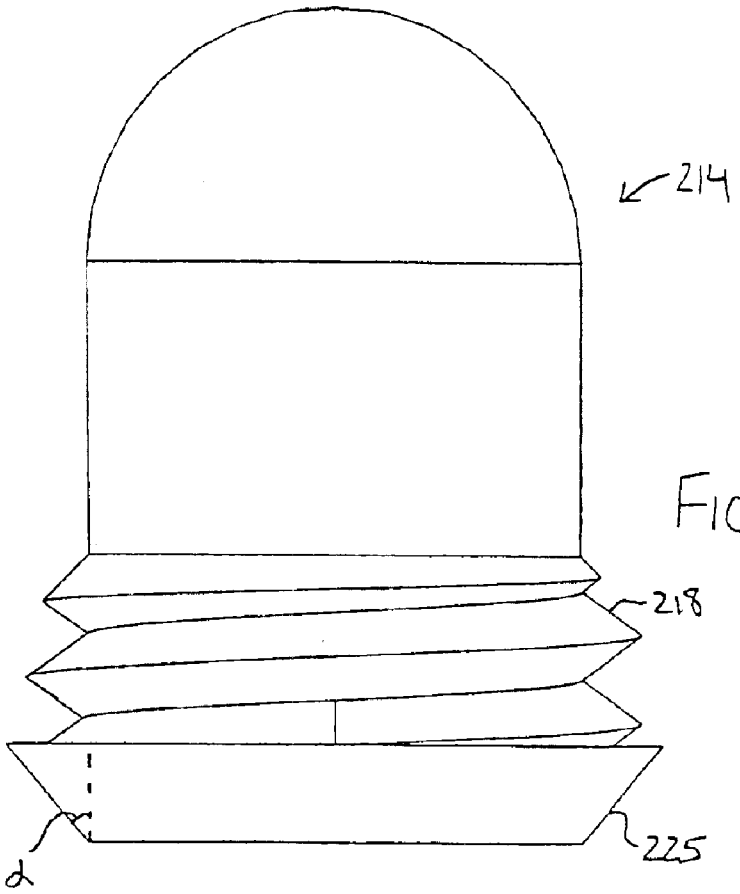
FIG. 18 is a side view of the cooling element of FIG. 17.
Figure 18A:
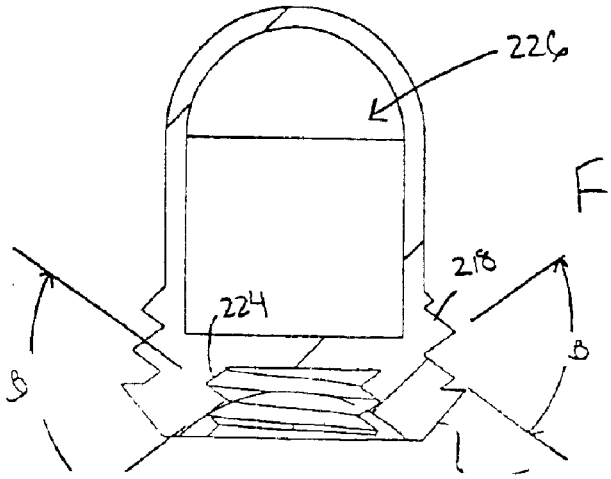
FIG. 18A is a cross sectional side view of the cooling element of FIG. 18.

Referring now to FIGS. 14 and 15, another embodiment of a beverage container 200 will be described. Container 200 comprises a base 202 and a vessel 204 having an open top end 206 and a closed bottom end 208 (see also FIG. 16) to permit vessel 204 to hold a beverage. Formed in bottom end 208 is a cavity 210 that extends up into an interior 212 of vessel 204. Cavity 210 is cylindrical in geometry at its base and hemispherical at its top to be able to receive a cooling element 214 (see FIGS. 17 and 18). The bottom of cavity 210 has female threads 216 for receiving corresponding male threads 218 on cooling element 214, although the male/female relationship of the threads may be swapped.

The top of cavity 210 is curved or rounded to maximize the amount of heating or cooling area in contact with the beverage. However, it will be appreciated that other shapes could be used as well. For example, it could be stepped, square, rectangular, or the like. When element 214 is screwed into cavity 210, the top end of element 214 comes into contact with the top end of cavity 210 to maximize heat transfer in a manner similar to that described with other embodiments. Also, additional support material may be included in the region where the outer walls of vessel 204 intersect cavity 210. In this way, vessel 204 is made more durable so that it will resist breaking when connection to base 202.

Figure 19:
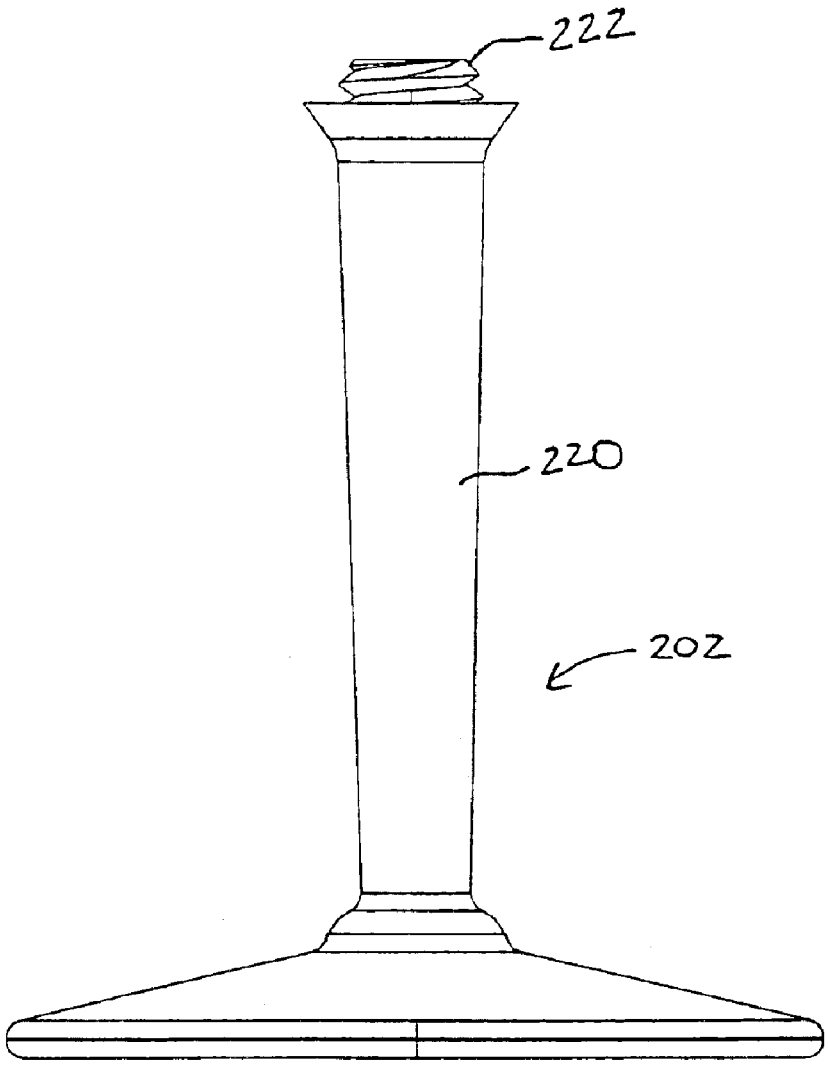
FIG. 19 is a side view of a base of the beverage container of FIG. 14.

One particular feature of cooling element 214 is that it also functions as a connector to connect vessel 204 to base 202. More specifically, base 202 includes a stem 220 (see FIG. 19) having a threaded top end 222. Element 214 also includes female threads 224 at its bottom end for receiving the threaded top end 222 of base 202, although the male/female relationship of the threads could be swapped. As best shown in FIG. 15, this arrangement permits vessel 204 to be coupled to base 202 without coming into contact with each other. This allows vessel 204 and base 202 to be constructed of relatively fragile materials, such as glass, ceramics, porcelain, china, and the like, and then connected to each other using a softer material as a connector. For example, connector 214 may be constructed of a plastic, acrylic, or the like. In this way, the more fragile materials used to construct base 202 and vessel 204 may be screwed into connector 214 without breaking. In some cases, the entire beverage container could be constructed of the same material, such as plastic, acrylic or the like. One exemplary material for constructing connector 214 is an acrylic material having a durometer in the range from about 30 to about 40, and more preferably about 35. Such a material has a small coefficient of thermal expansion so that it does not excessively shrink or expand due to changes in temperature. Further, the material is hard enough so that a stable connection is provided between base 202 and vessel 204. At the same time, the material is soft enough to prevent breakage of the vessel 204 or the base 202.

Connector 214 also includes a tapered end 225 that serves as a buffer between base 202 and vessel 204 so that the two pieces never come into direct contact. This also helps to prevent base 202 and vessel 204 from breaking. Conveniently, the taper of end 225 matches the angle of vessel 204 so that a smooth, continuous surface is provided along the exterior of container 206. For instance, the angle of taper, alpha, may be in the range from about 35 to about 45 degrees.

The use of glass to construct vessel 204 and base 202 is important because many establishments, such as restaurants demand containers made of glass. Also, glass is aesthetically pleasing and easy to wash using conventional dishwashers. Container 200 is easy to assemble and reuse simply by screwing and unscrewing the pieces.

Another important feature of container 200 is the amount of pitch used with threads 218 and 224. The pitch is selected such that it takes about a half a turn to insert and remove connector 214 and to connect and remove base 202 to and from connector 214. By requiring only a single twist to connect the components, the chances of breakage are reduced. Further, it is relatively easy to connect and disconnect the pieces since it may be done with a single twist. In one aspect, the angle, beta, of threads 218 and 224 may be in the range from about 45 degrees to about 90 degrees, in some cases from about 65 degrees to about 75 degrees, and in some case about 70 degrees. This minimizes the number of threads to minimize the amount of turning required. It also provides sufficient threads so that the components are securely held together. However, the pitch may be configured so that the pieces separate when turned about ¼ turn to about one turn or more.

Cooling element 214 includes an open interior 226 for holding a cooling substance similar to other embodiments. In this way, cooling element 214 may be removed and placed in a freezer for cooling. Also similar to other embodiments, a tray may be used to hold multiple cooling elements 214.

Figure 18B:
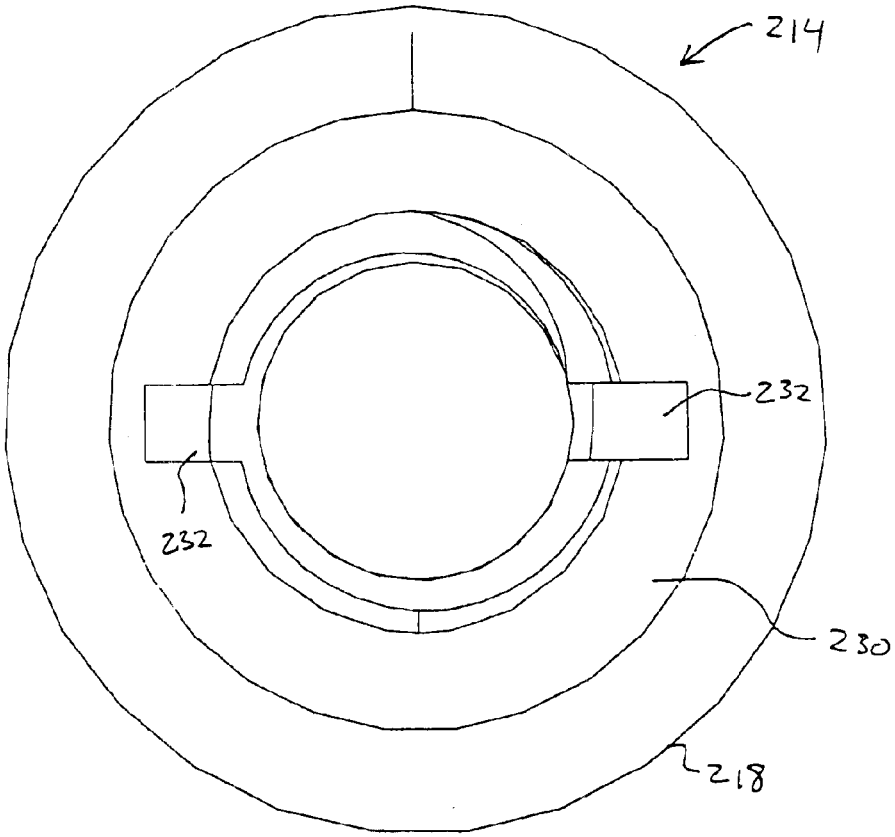
FIG. 18B is a bottom view of the cooling element of FIG. 17.

As shown in FIG. 18B, cooling element 214 has a bottom end 230 that may include one ore more slots 232, detents or the like. This provides an easy way to disengage or remove cooling element from vessel 204. Examples of tools that may be used to engage slots 232 include coins (such as a quarter), a screw driver, a fingernail, a knife, or the like.

Referring to FIGS. 20–23, another embodiment of a beverage container 300 will be described. Container 300 comprises a base 302 and a vessel 304 having an open top end 306 and a closed bottom end 308 (see also FIGS. 22 and 23) to permit vessel 304 to hold a beverage. Formed in bottom end 308 is a cavity 310 that extends up into an interior 312 of vessel 304. Cavity 310 is cylindrical in geometry at its base and hemispherical at its top to receive a cooling element 314 (see FIG. 21) that is similar to cooling element 214 in other embodiments. The bottom of cavity 310 has threads 316 for receiving corresponding threads cooling element 314.

Cavity 310 has a top 311 that is curved or rounded to maximize the amount of heating or cooling area in contact with the beverage. However, it will be appreciated that other shapes could be used as well. For example, it could be stepped, square, rectangular, pyramid shaped or the like. When element 314 is screwed into cavity 310, the top end of element 314 comes into contact with the top end 311 of cavity 310 to maximize heat transfer in a manner similar to that described with other embodiments. Also, additional support material may be included in the region where the outer walls of vessel 304 intersect cavity 310. In this way, vessel 304 is made more durable so that it will resist breaking when connection to base 302.

Figure 20:
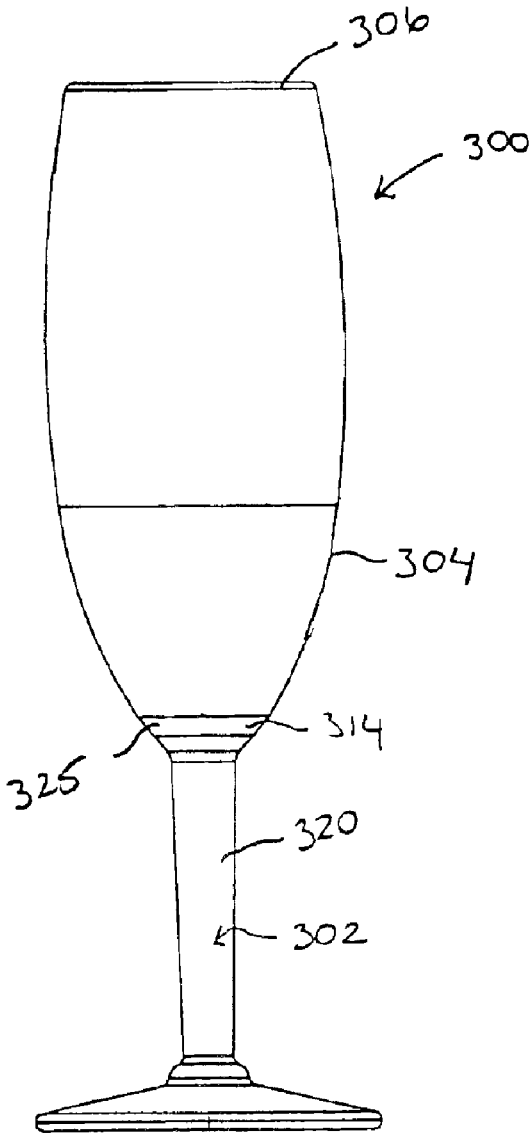
FIG. 20 is a front view of another embodiment of a beverage container according to the invention.
Figure 21:
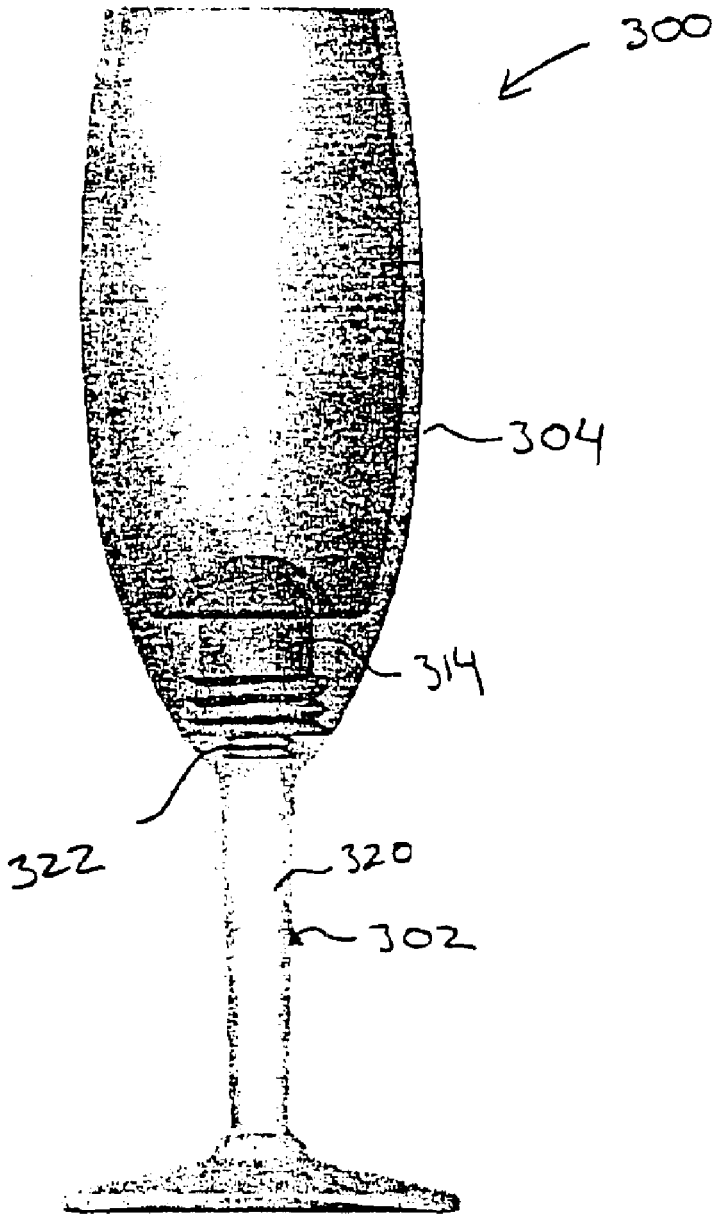
FIG. 21 is a sectional view of the beverage container of FIG. 20.
Figure 22:
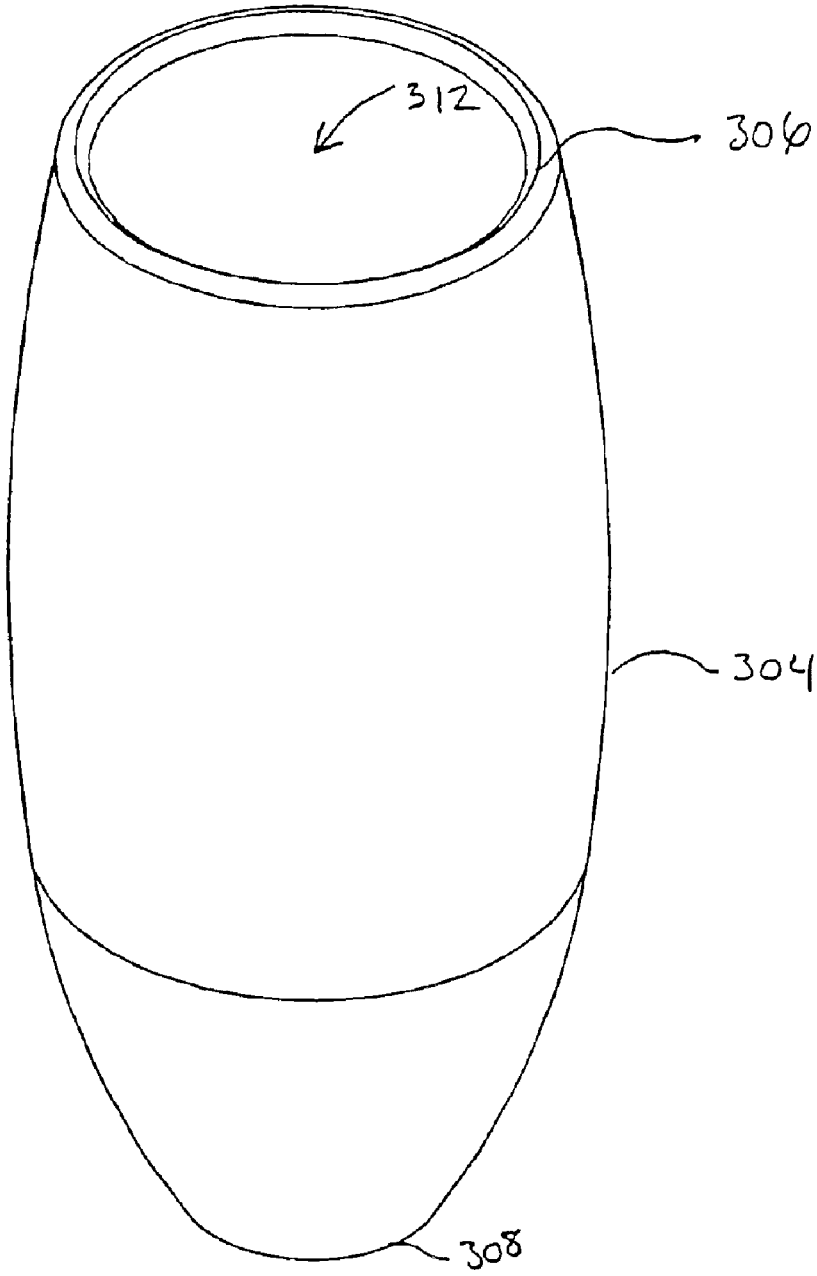
FIG. 22 is a perspective view of a vessel of the container of FIG. 20.
Figure 23:
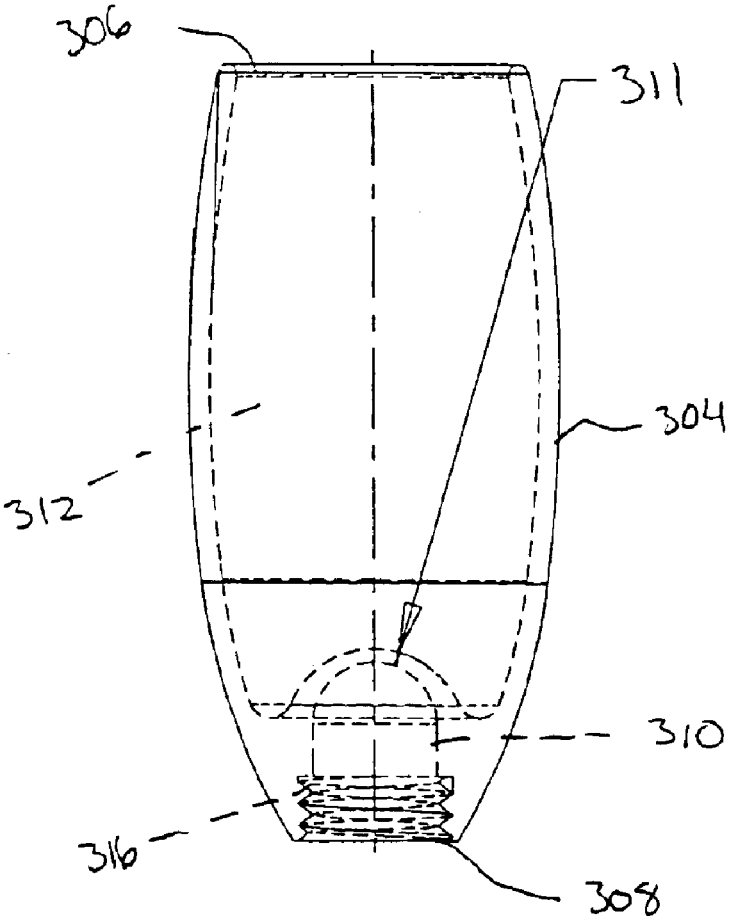
FIG. 23 is a front view of the vessel of FIG. 22.

One particular feature of cooling element 314 is that it also functions as a connector to connect vessel 304 to base 302. More specifically, base 302 includes a stem 320 (see FIGS. 20 and 21) having a threaded top end 322. Element 314 also includes threads at its bottom end for receiving the threaded top end 322 of base 302. As best shown in FIG. 20, this arrangement permits vessel 304 to be coupled to base 302 without coming into contact with each other. This allows vessel 304 and base 302 to be constructed of relatively fragile materials, such as glass, ceramics, porcelain, china, and the like, and then connected to each other using a softer material as a connector. For example, connector 314 may be constructed of a plastic, acrylic, or the like. In this way, the more fragile materials used to construct base 302 and vessel 304 may be screwed into connector 314 without breaking. Also, connector 314 accommodates expansion and contraction of the other pieces during heating or cooling. In some cases, the entire beverage container could be constructed of the same material, such as plastic, acrylic or the like. One exemplary material for constructing connector 314 is an acrylic material having a durometer in the range from about 30 to about 40, and more preferably about 35. Such a material has a small coefficient of thermal expansion so that it does not excessively shrink or expand due to changes in temperature. Further, the material is hard enough so that a stable connection is provided between base 302 and vessel 304. At the same time, the material is soft enough to prevent breakage of the vessel 304 or the base 302.

Connector 314 also includes a tapered end 325 (see FIG. 20) that serves as a buffer between base 302 and vessel 304 so that the two pieces never come into direct contact. This also helps to prevent base 302 and vessel 304 from breaking. Conveniently, the taper of end 325 matches the angle of vessel 304 so that a smooth, continuous surface is provided along the exterior of container 300.

Another important feature of container 300 is that it takes about a half a turn to insert and remove connector 314 and to connect and remove base 302 to and from connector 314 similar to other embodiments. However, the pitch may be configured so that the pieces separate when turned about ¼ turn to about one turn or more.

Referring to FIGS. 24–28, another embodiment of a beverage container 400 will be described. Container 400 comprises a base 402 and a vessel 404 having an open top end 406 and a closed bottom end 408 (see FIGS. 27 and 28) to permit vessel 404 to hold a beverage. Formed in bottom end 408 is a cavity 410 that extends up into an interior 412 of vessel 404. Cavity 410 is cylindrical in geometry at its base and hemispherical at its top to receive a cooling element 414 (see FIG. 25) that is similar to cooling element 214 in other embodiments. The bottom of cavity 410 has threads 416 for receiving corresponding threads cooling element 414.

Cavity 410 has a top 411 that is curved or rounded to maximize the amount of heating or cooling area in contact with the beverage. However, it will be appreciated that other shapes could be used as well. For example, it could be stepped, square, rectangular, pyramid shaped or the like. When element 414 is screwed into cavity 410, the top end of element 414 comes into contact with the top end 411 of cavity 410 to maximize heat transfer in a manner similar to that described with other embodiments. Also, additional support material may be included in the region where the outer walls of vessel 404 intersect cavity 410. In this way, vessel 404 is made more durable so that it will resist breaking when connection to base 402.

Figure 24:
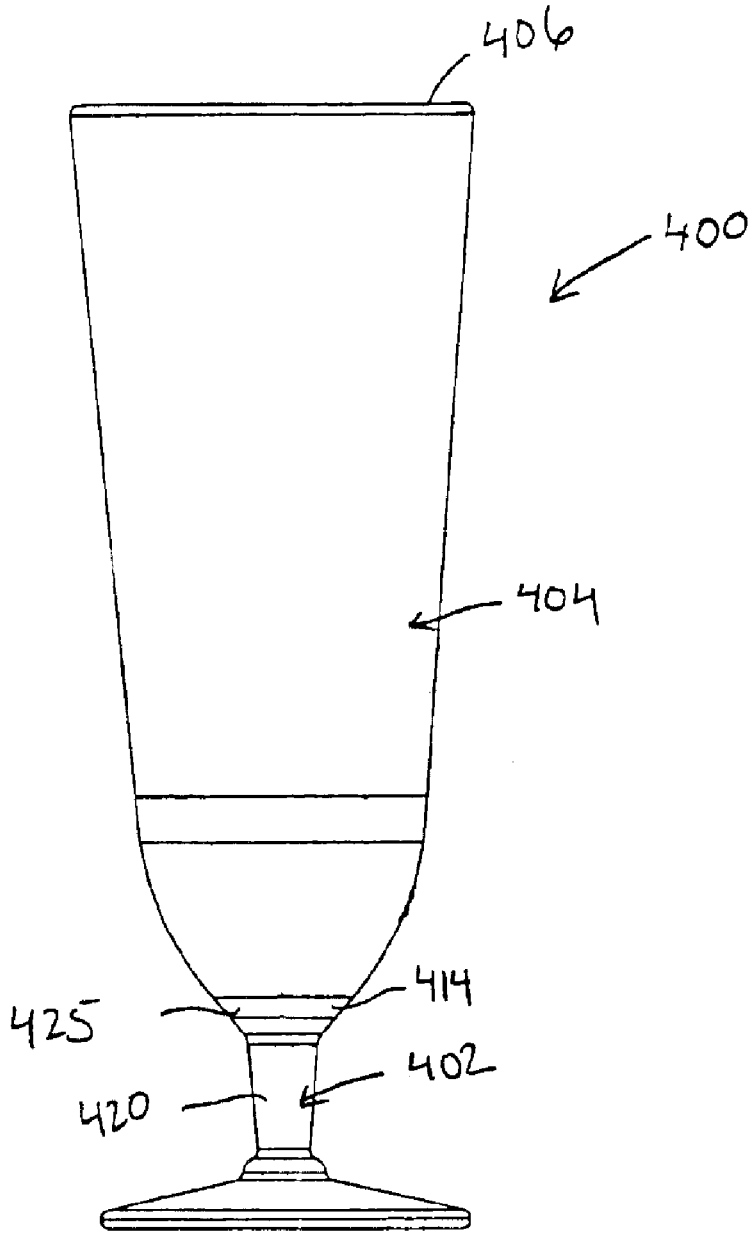
FIG. 24 is a front view of another embodiment of a beverage container according to the invention.
Figure 25:
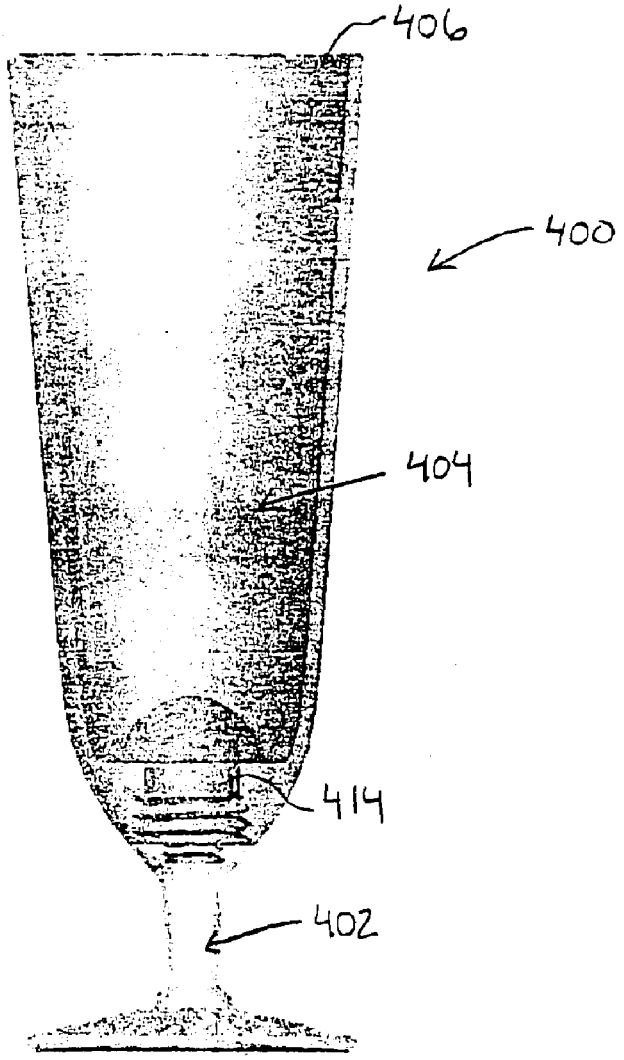
FIG. 25 is a sectional view of the beverage container of FIG. 24.
Figure 26:
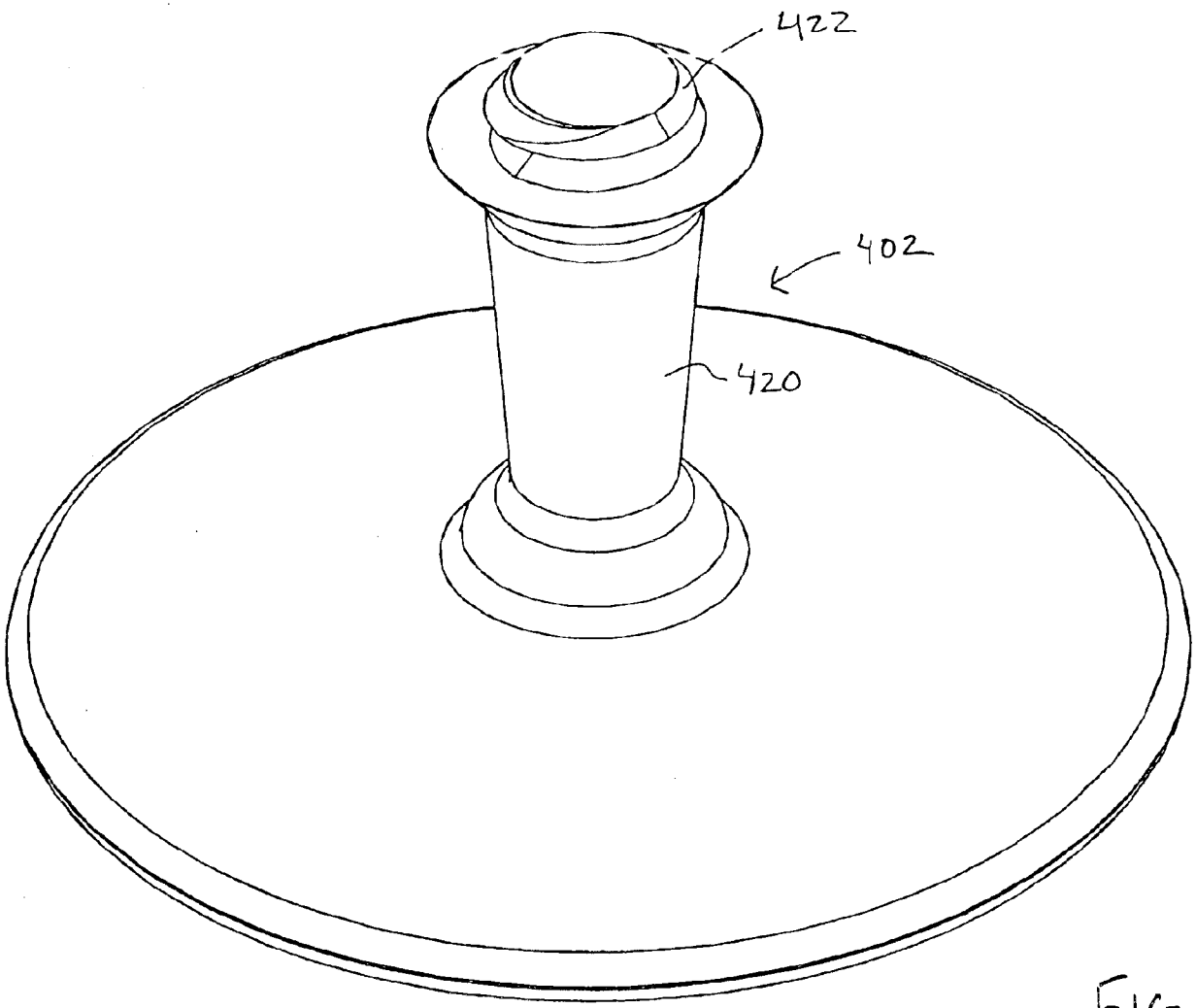
FIG. 26 is a perspective view of a base of the container of FIG. 24.
Figure 27:
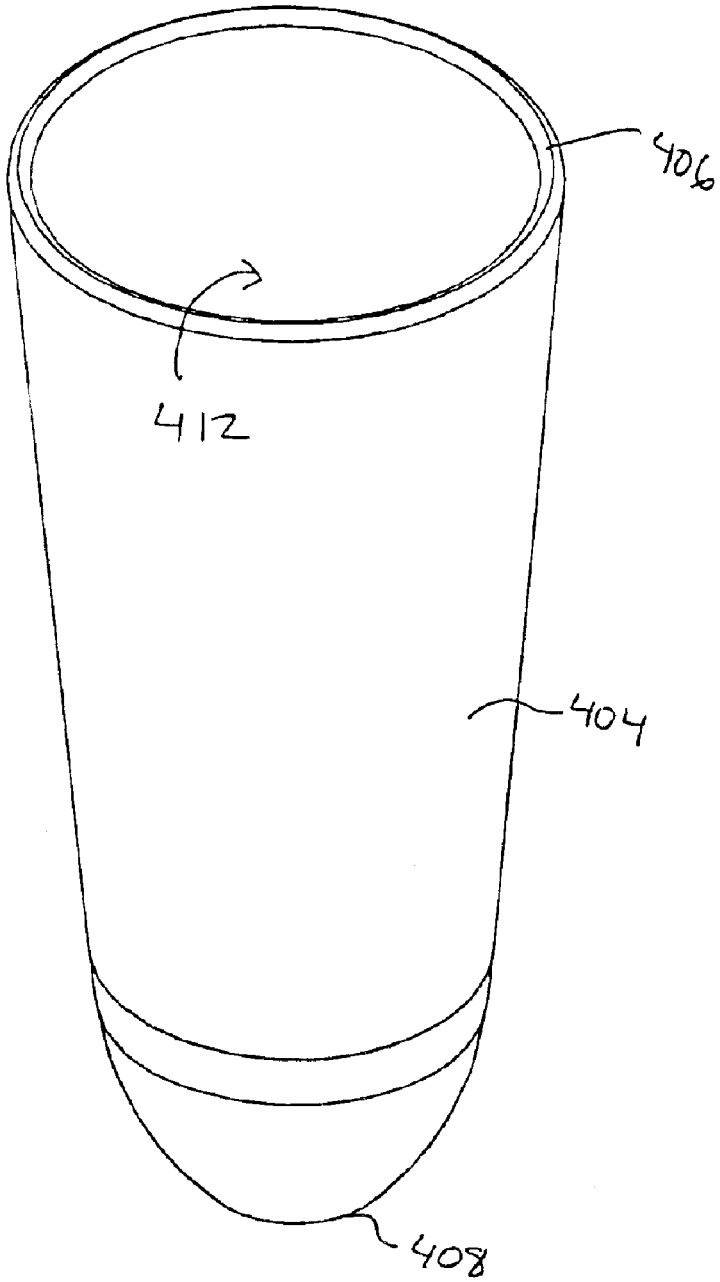
FIG. 27 is a perspective view of a vessel of the container of FIG. 24.
Figure 28:
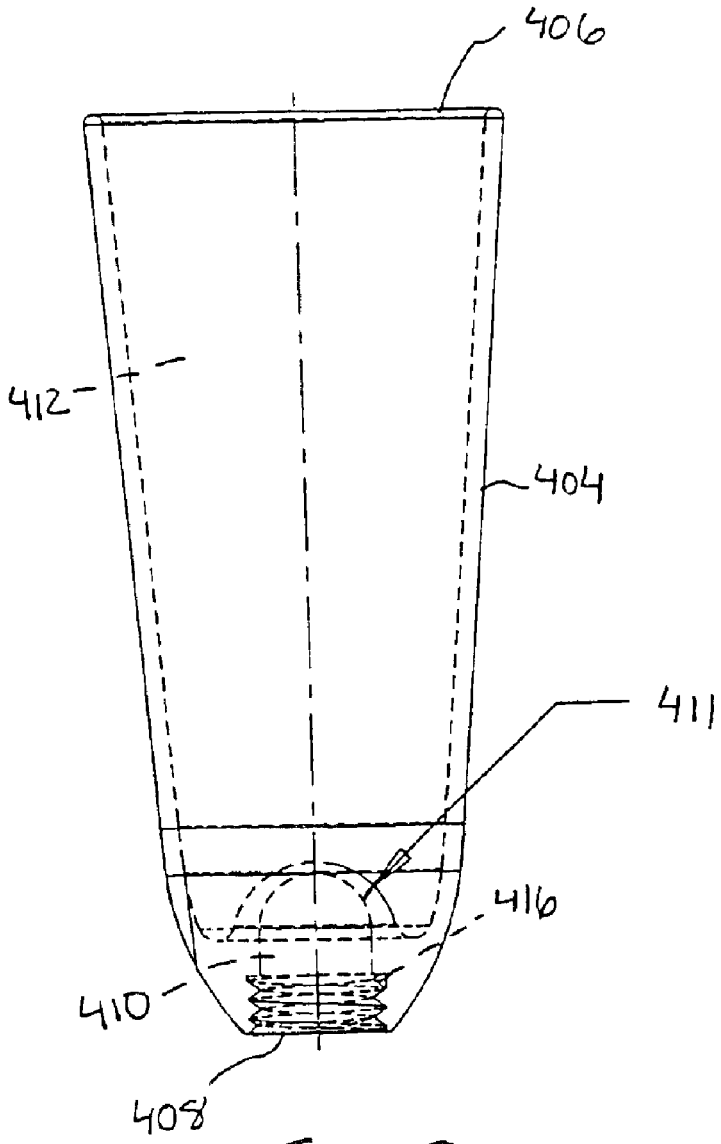
FIG. 28 is a front view of the vessel of FIG. 27.

One particular feature of cooling element 414 is that it also functions as a connector to connect vessel 404 to base 402. More specifically, base 402 includes a stem 420 (see FIGS. 24 and 26) having a threaded top end 422. Element 414 also includes threads at its bottom end for receiving the threaded top end 422 of base 402. As best shown in FIG. 24, this arrangement permits vessel 404 to be coupled to base 402 without coming into contact with each other. This allows vessel 404 and base 402 to be constructed of relatively fragile materials, such as glass, ceramics, porcelain, china, and the like, and then connected to each other using a softer material as a connector. For example, connector 414 may be constructed of a plastic, acrylic, or the like. In this way, the more fragile materials used to construct base 402 and vessel 404 may be screwed into connector 414 without breaking. Also, connector 414 accommodates expansion and contraction of the other pieces during heating or cooling. In some cases, the entire beverage container could be constructed of the same material, such as plastic, acrylic or the like. One exemplary material for constructing connector 414 is an acrylic material having a durometer in the range from about 30 to about 40, and more preferably about 35. Such a material has a small coefficient of thermal expansion so that it does not excessively shrink or expand due to changes in temperature. Further, the material is hard enough so that a stable connection is provided between base 402 and vessel 404. At the same time, the material is soft enough to prevent breakage of the vessel 404 or the base 402.

Connector 414 also includes a tapered end 425 (see FIG. 24) that serves as a buffer between base 402 and vessel 404 so that the two pieces never come into direct contact. This also helps to prevent base 402 and vessel 404 from breaking. Conveniently, the taper of end 425 matches the angle of vessel 404 so that a smooth, continuous surface is provided along the exterior of container 400.

Another important feature of container 400 is that it takes about a half a turn to insert and remove connector 414 and to connect and remove base 402 to and from connector 414 similar to other embodiments. However, the pitch may be configured so that the pieces separate when turned about ¼ turn to about one turn or more.

Figure 29:
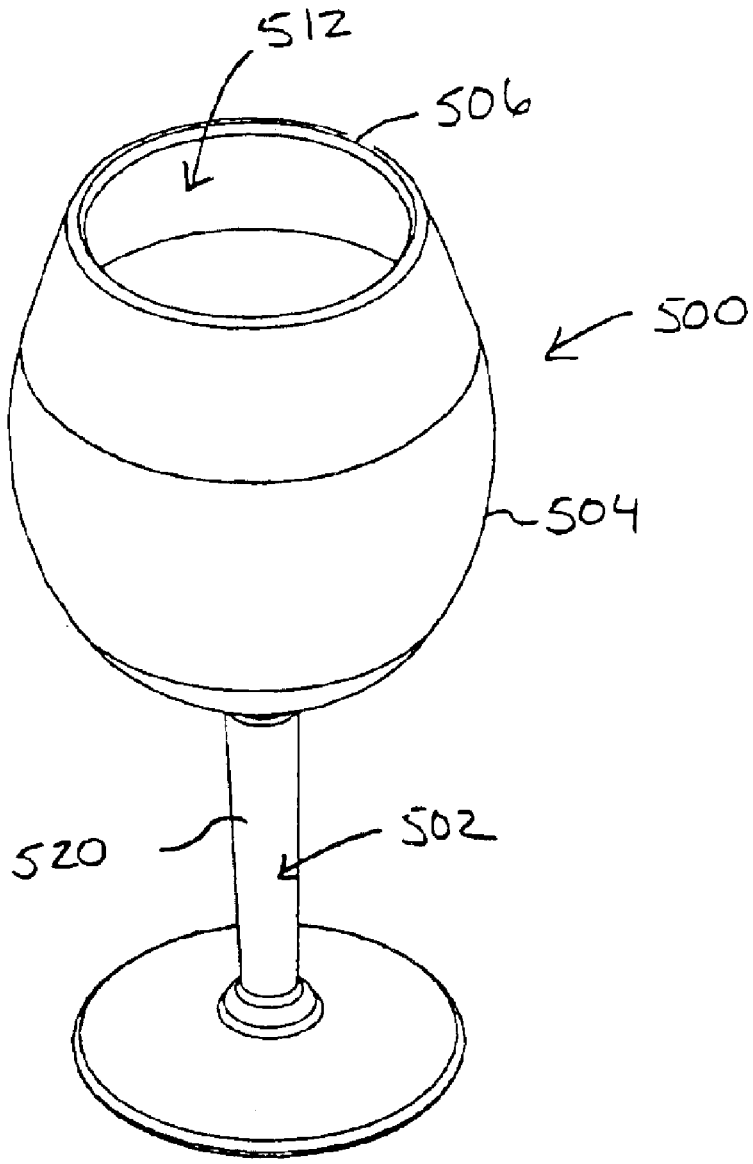
FIG. 29 is a perspective view of a further embodiment of a beverage container according to the invention.
Figure 30:
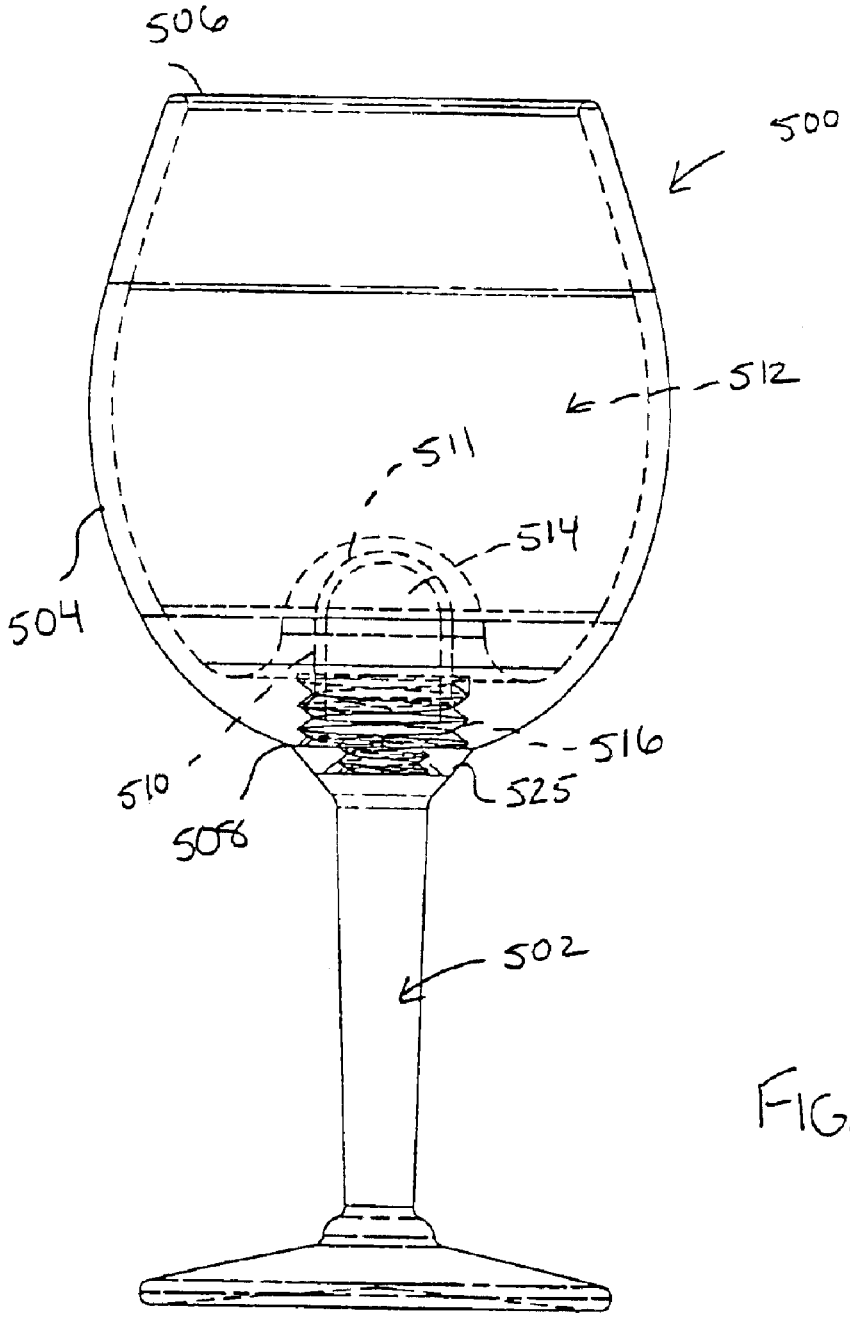
FIG. 30 is a front view the beverage container of FIG. 29.
Figure 31:
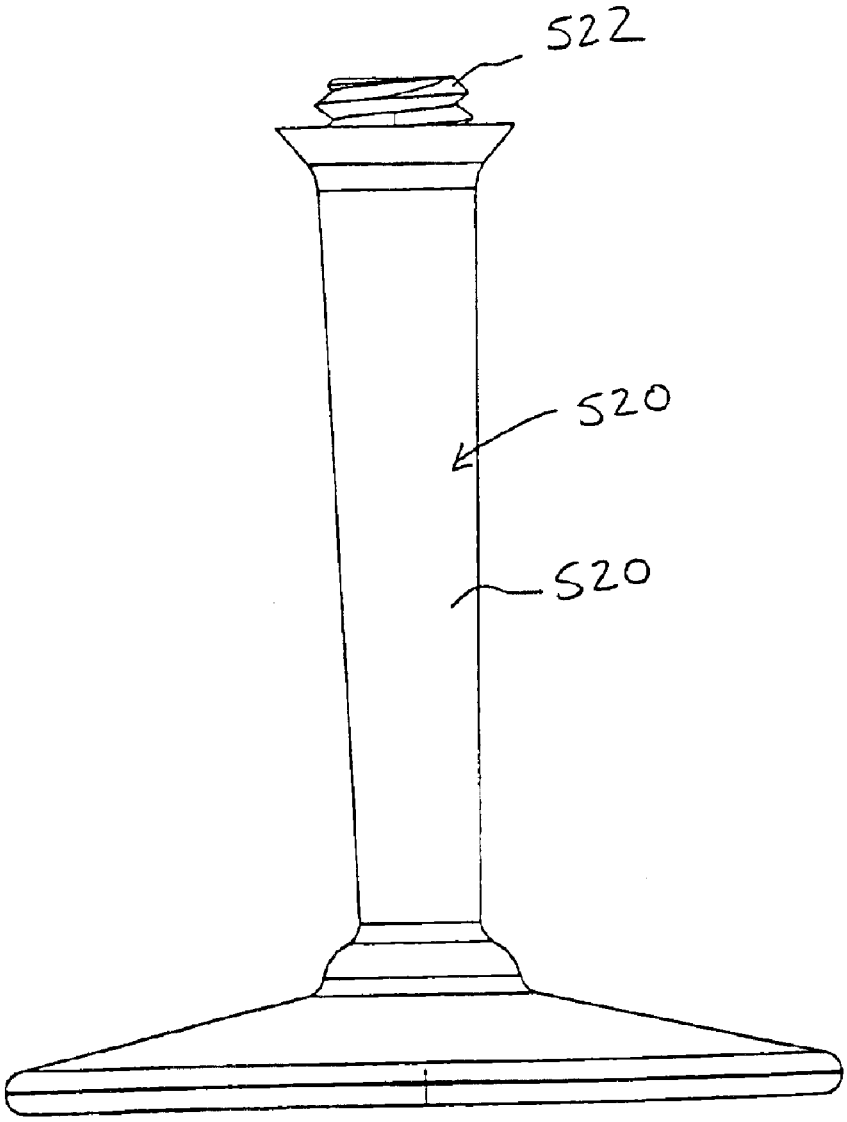
FIG. 31 is a front view of a base of the container of FIG. 29.
Figure 1:
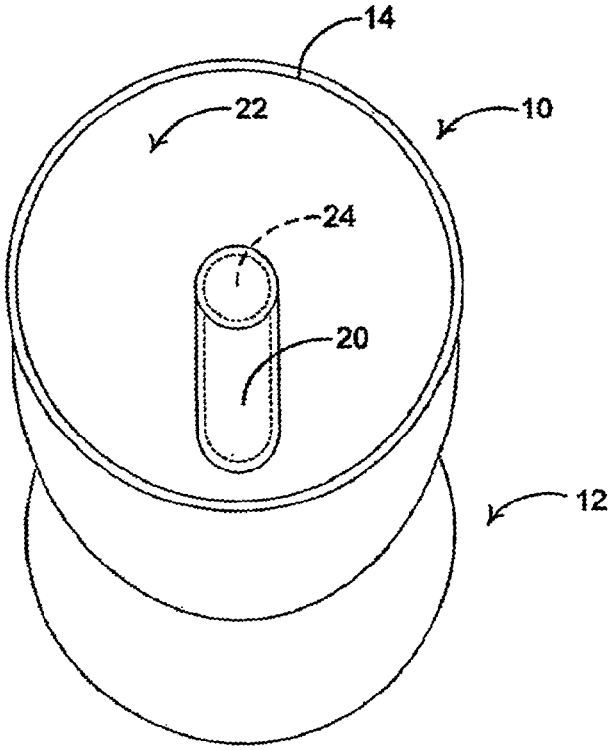
Figure 2:
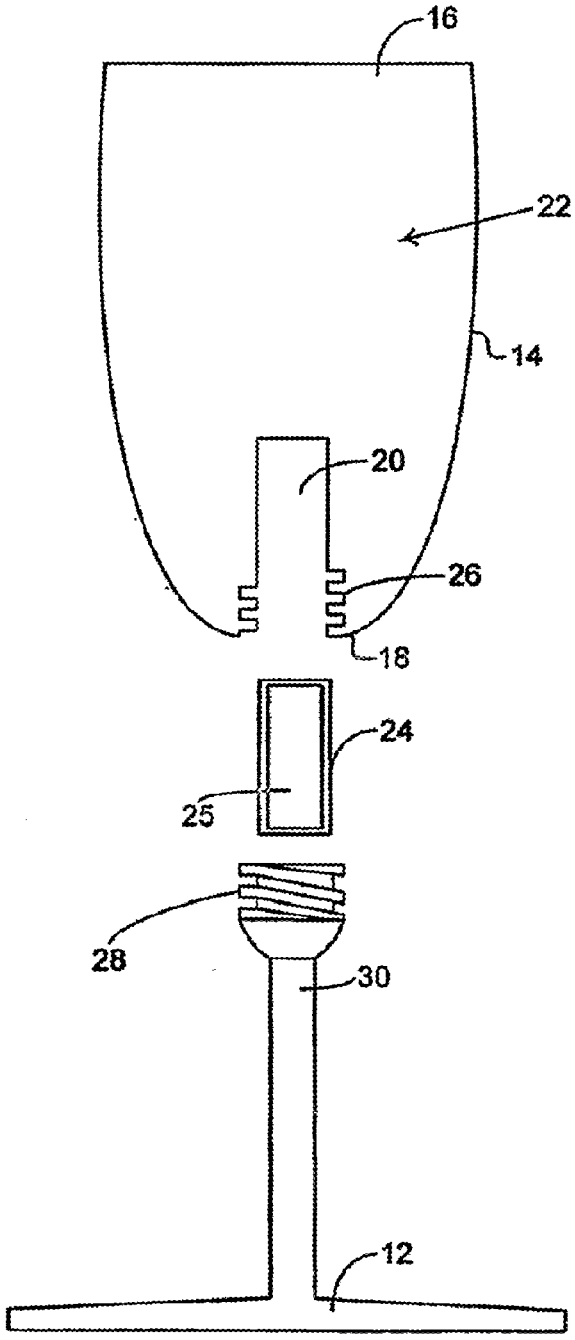
Figure 3:
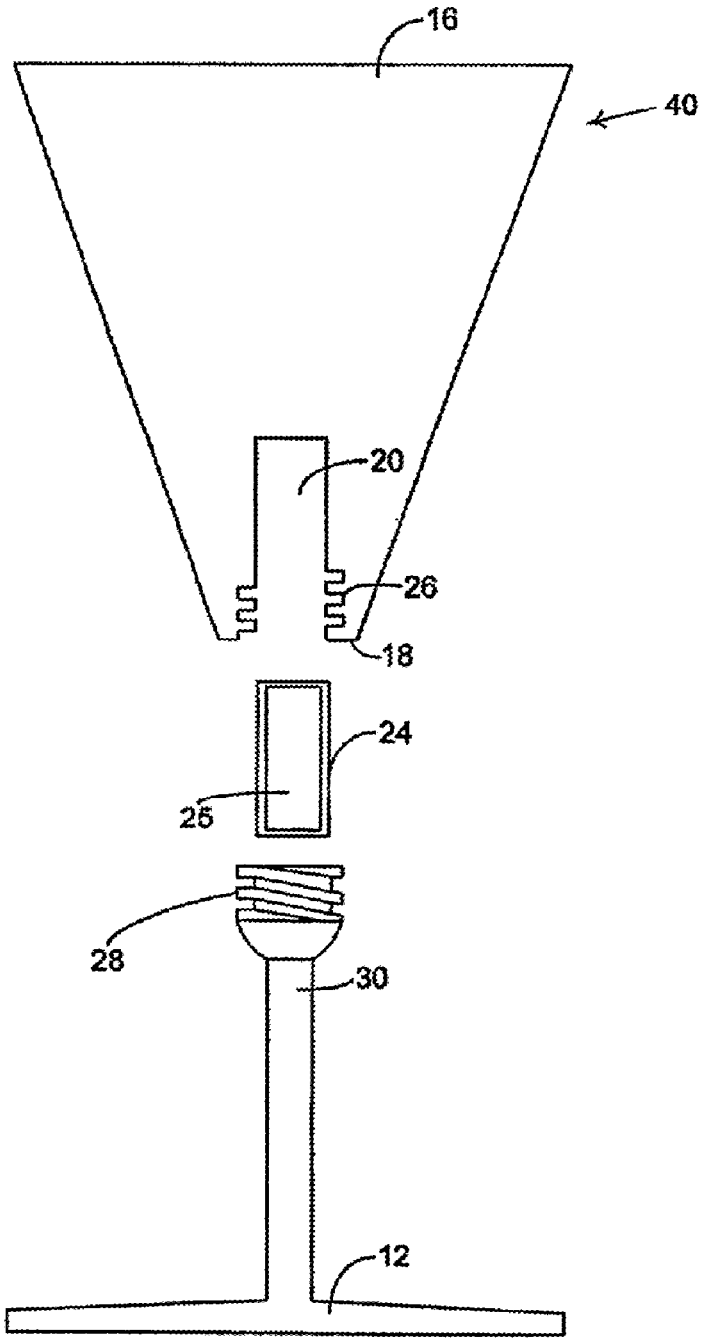
Figure 4:
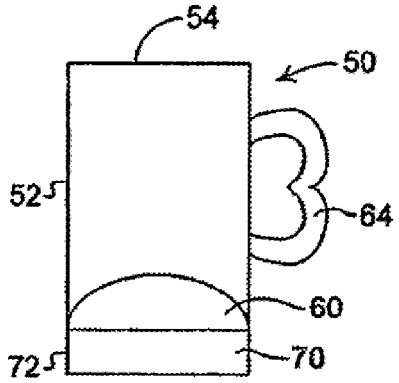
Figure 5:
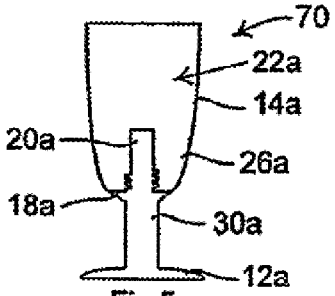
Figure 6:
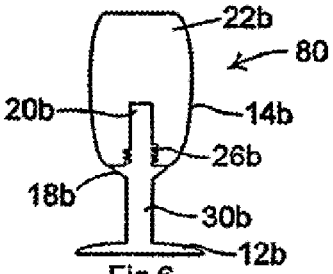
Figure 7:
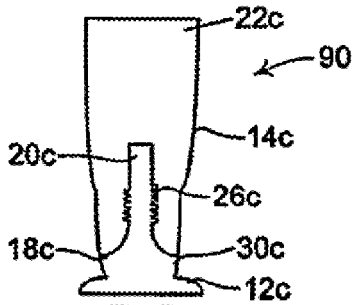
Figure 8:
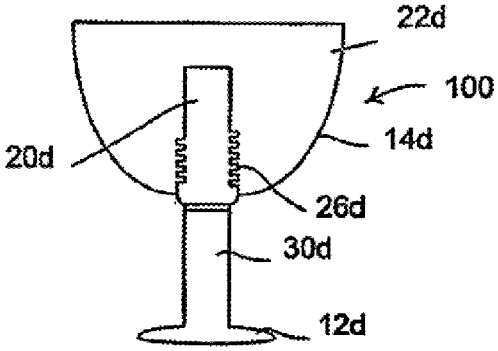
Figure 9:
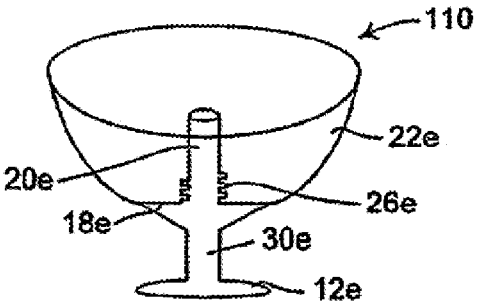
Figure 10:
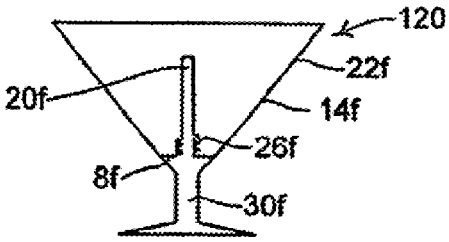
Figure 11:
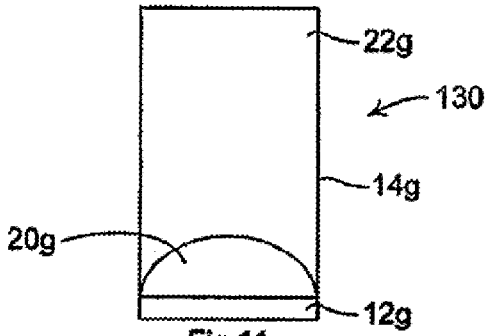
Figure 4A:
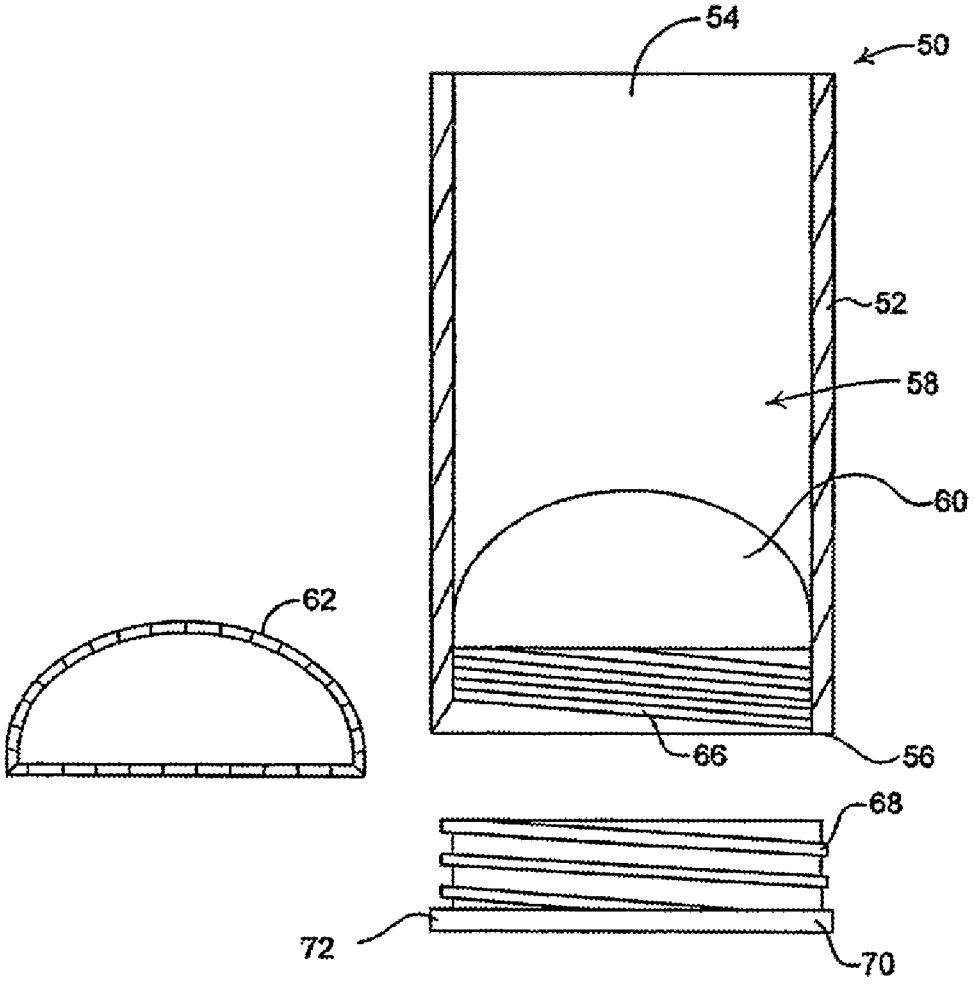
Figure 12:
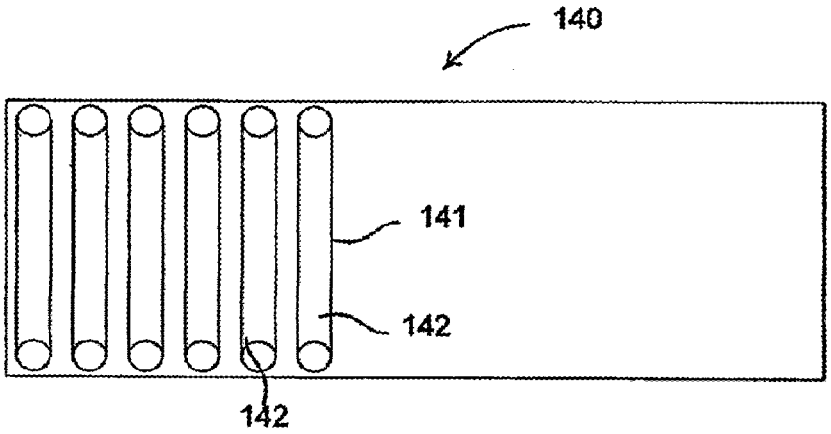
Figure 13:
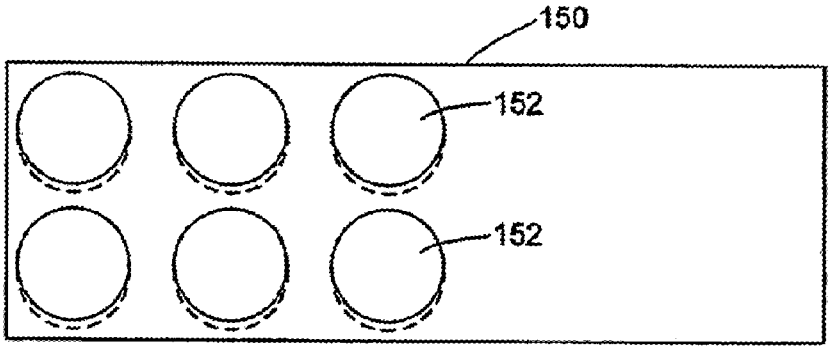
Figure 14:
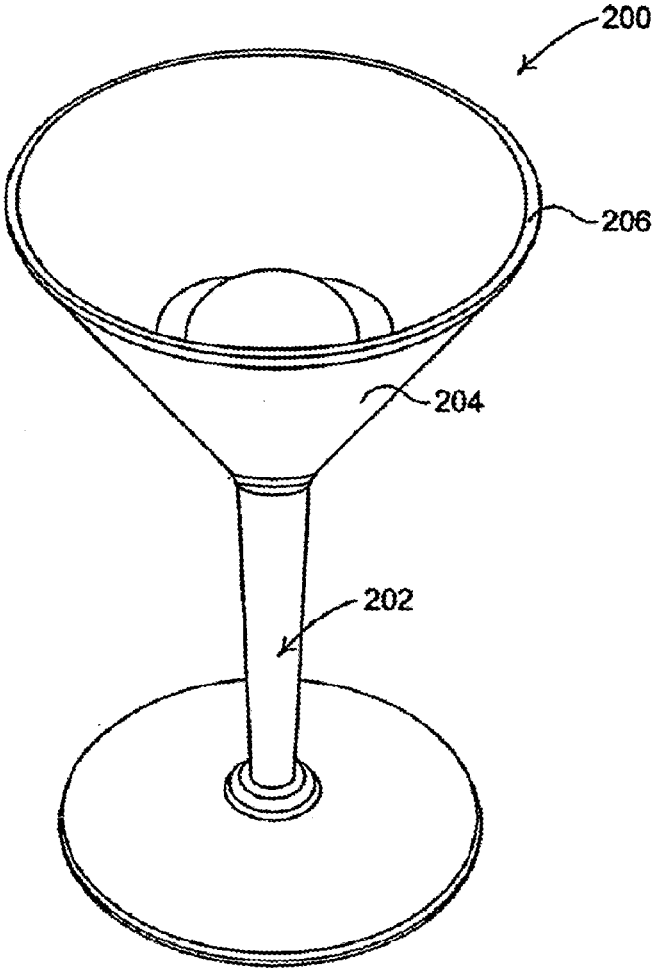
Figure 15:
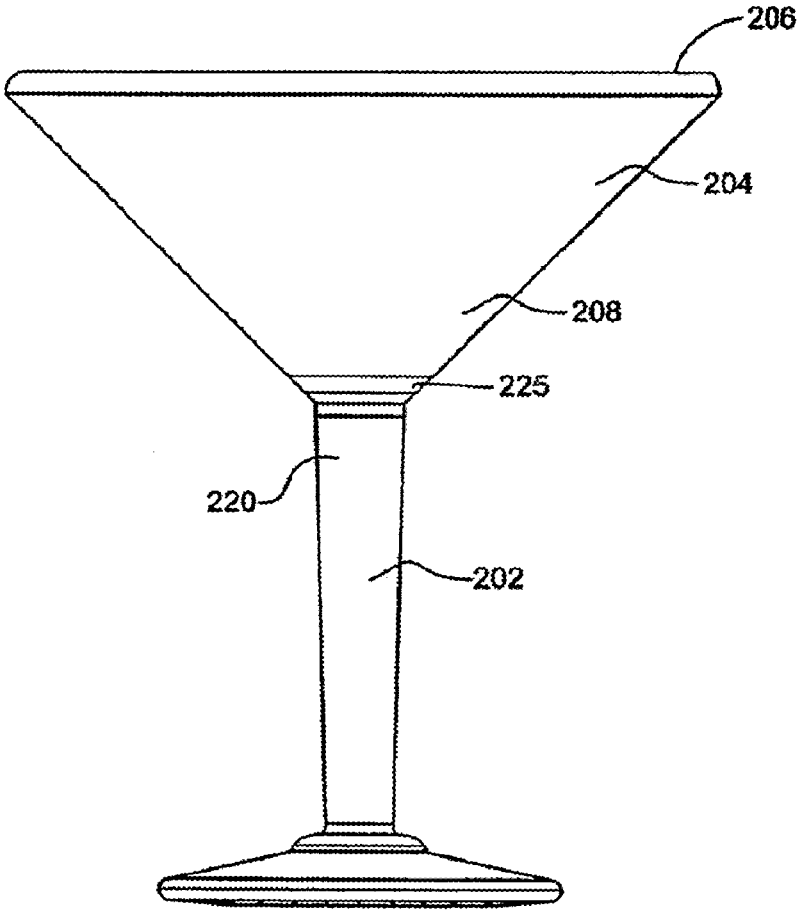
Figure 16:
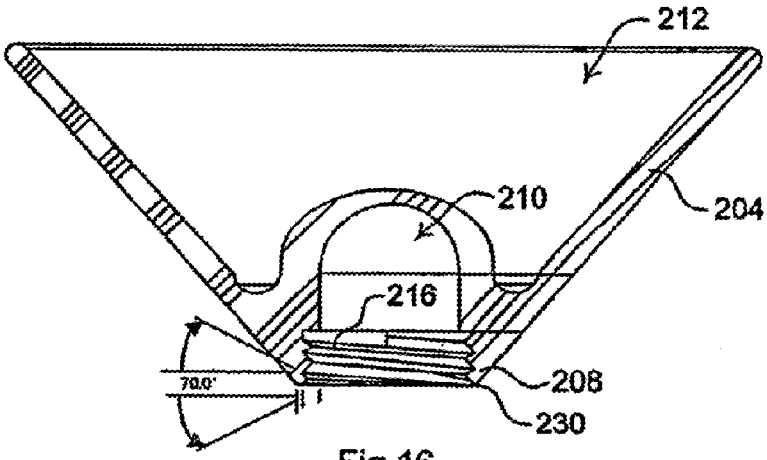
Figure 17:
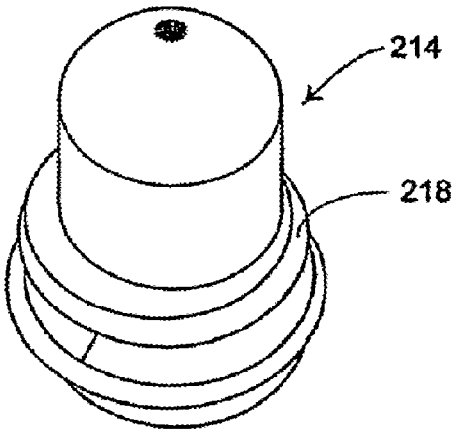
Figure 18:
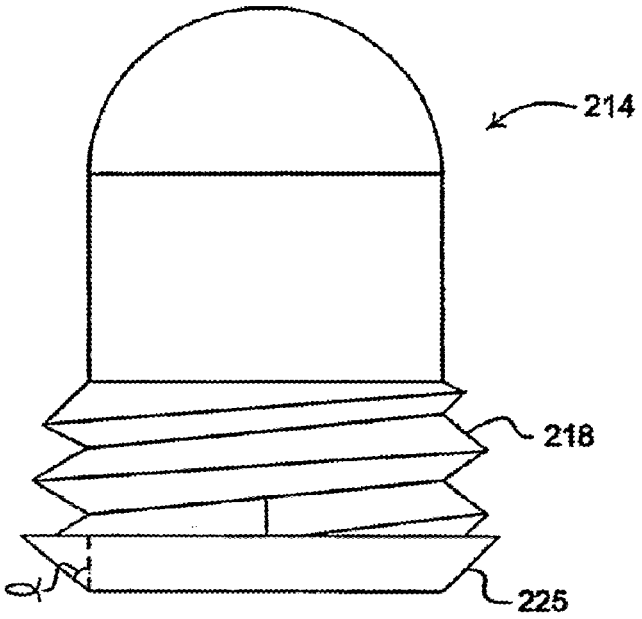
Figure 18A:
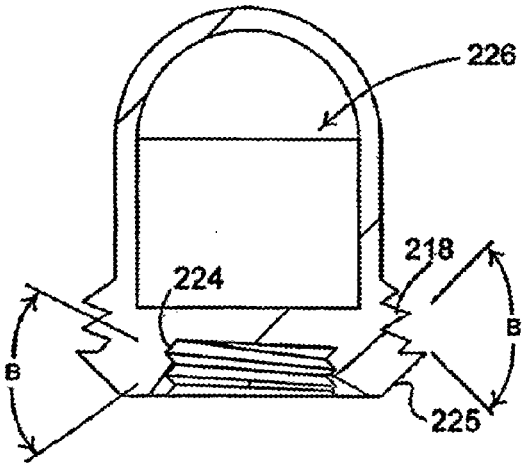
Figure 18B:
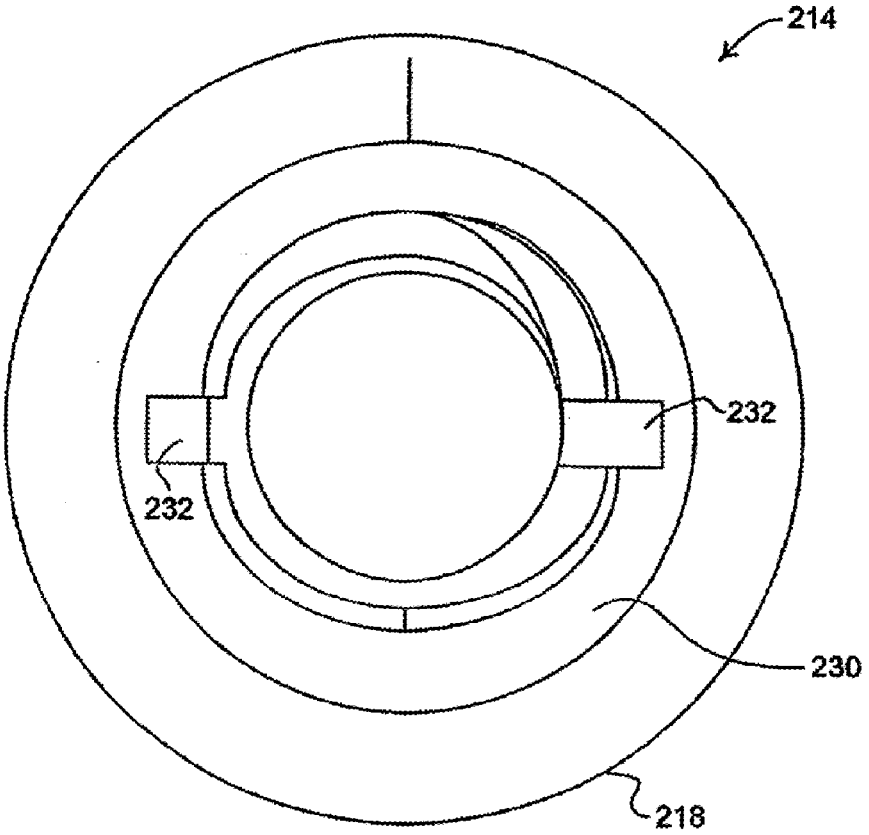
Figure 19:
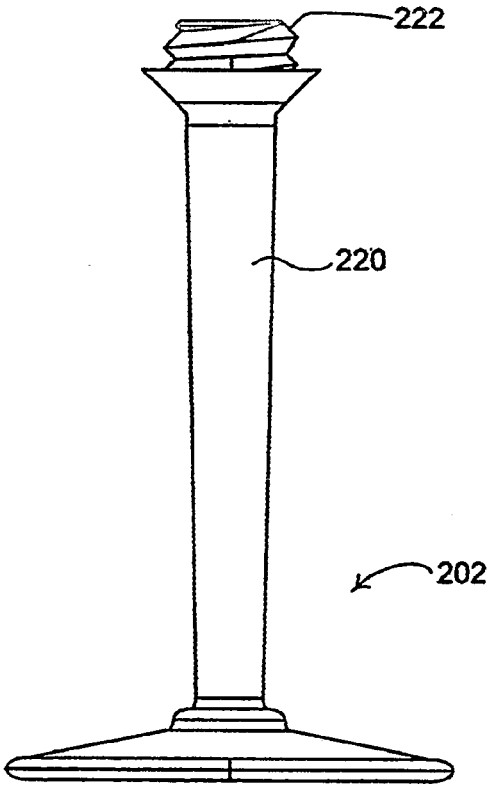
Figure 20:
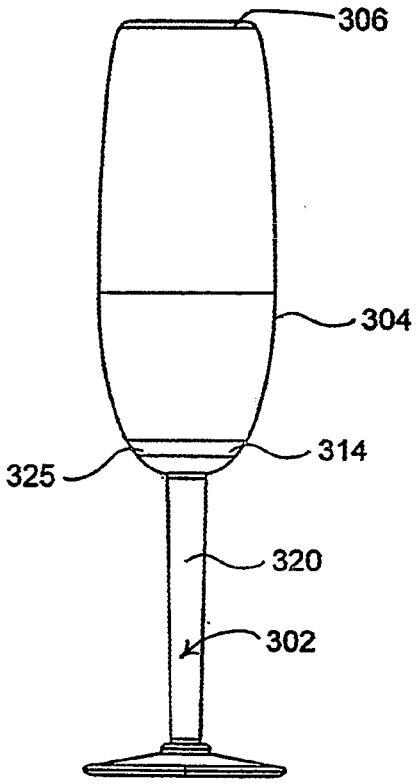
Figure 21:
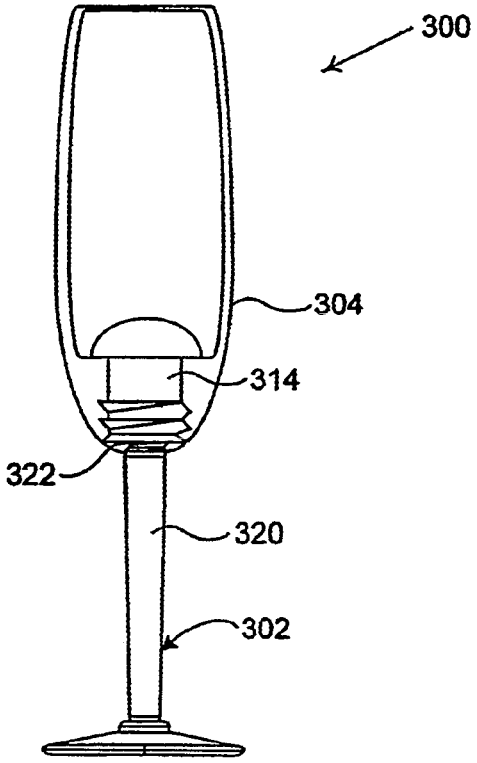
Figure 22:
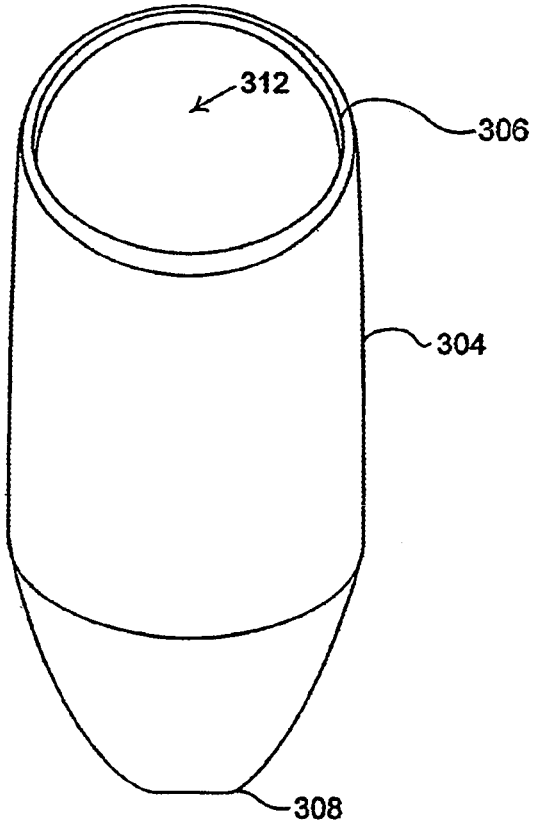
Figure 23:
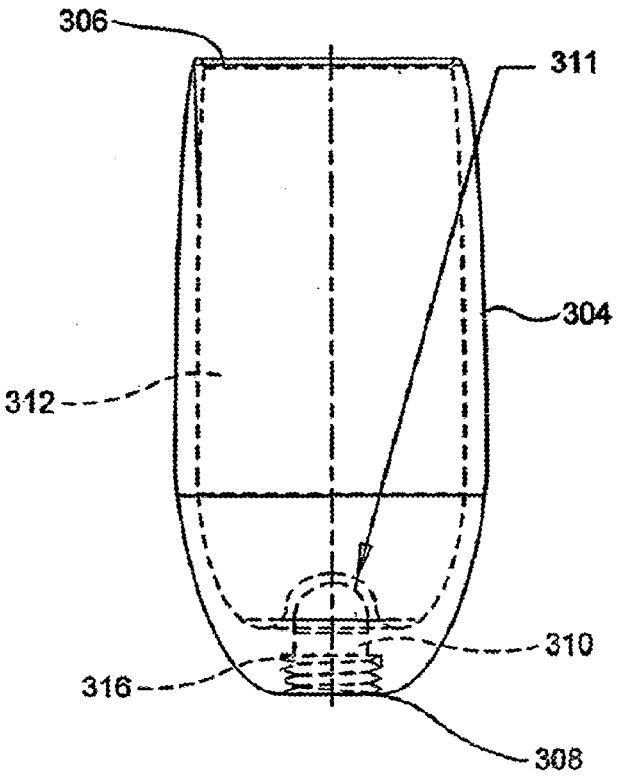
Figure 24:
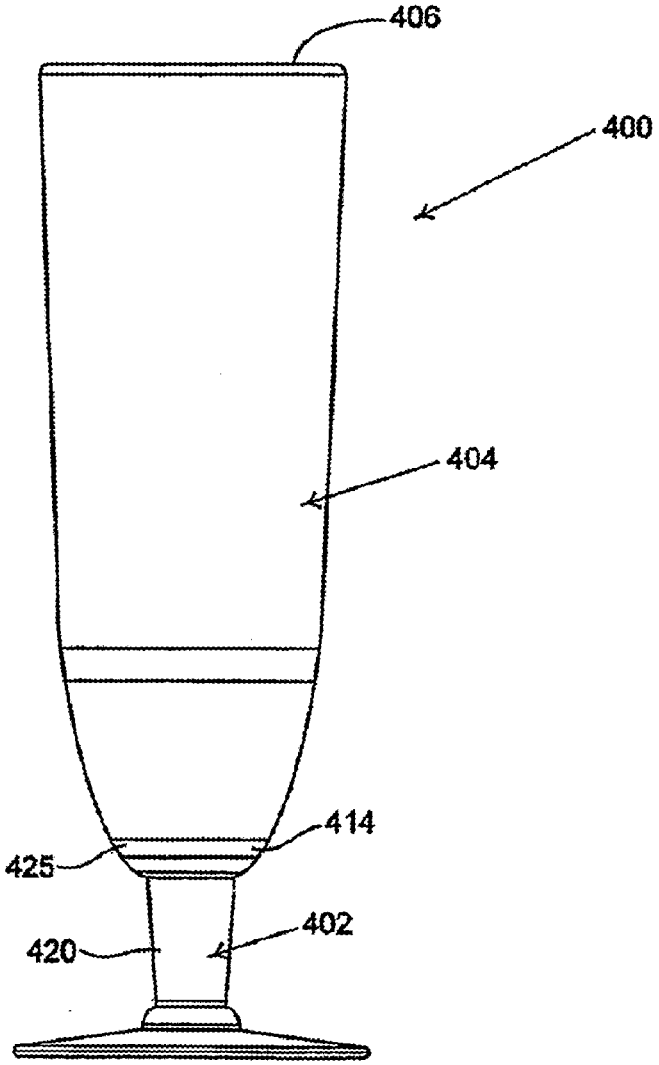
Figure 25:
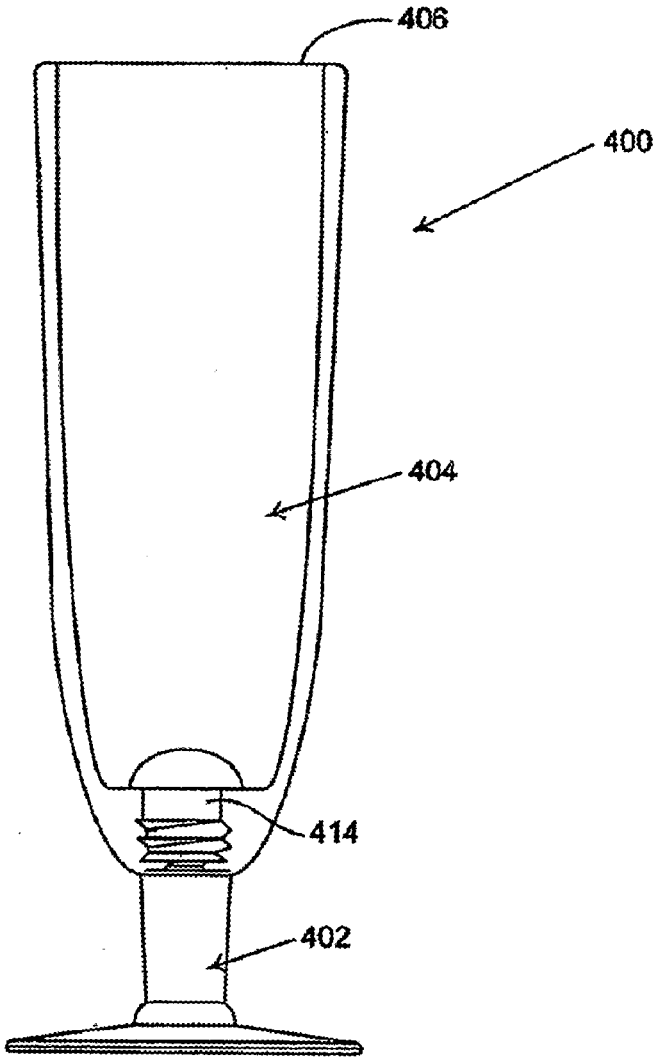
Figure 26:
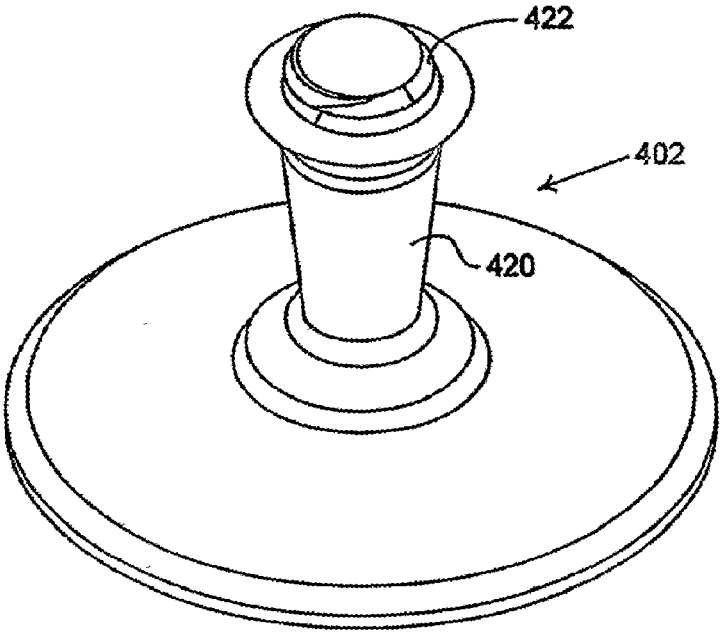
Figure 27:
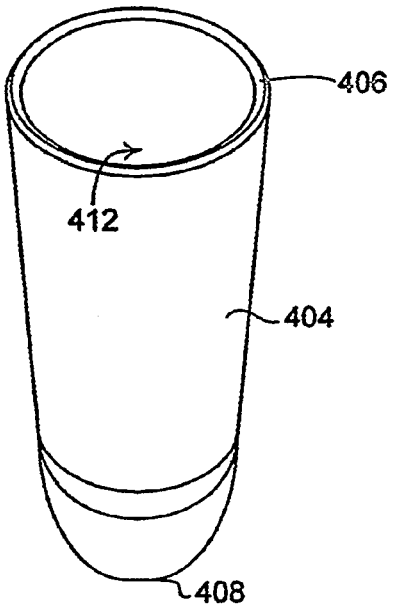
Figure 28:
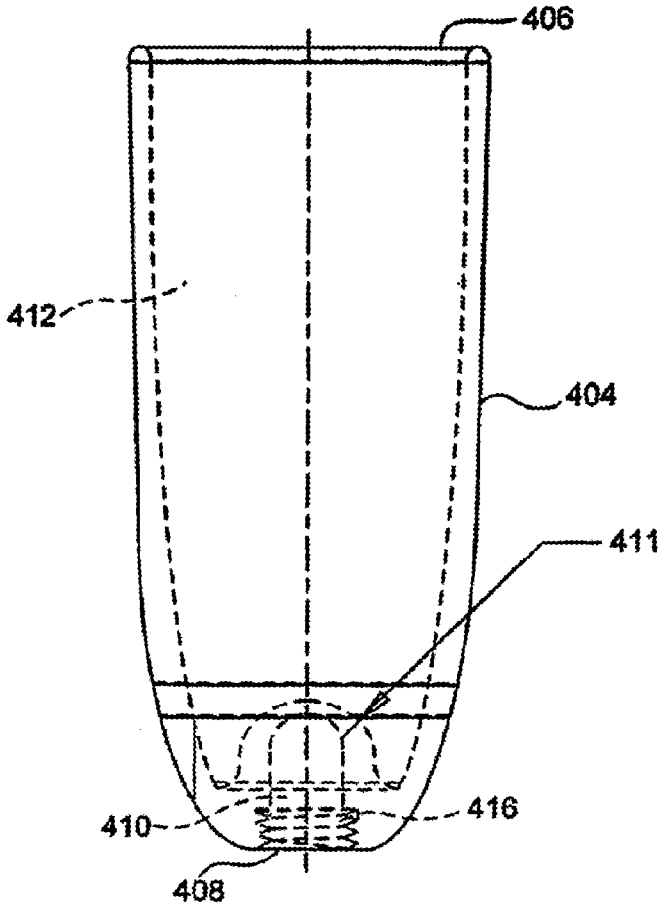
Figure 29:
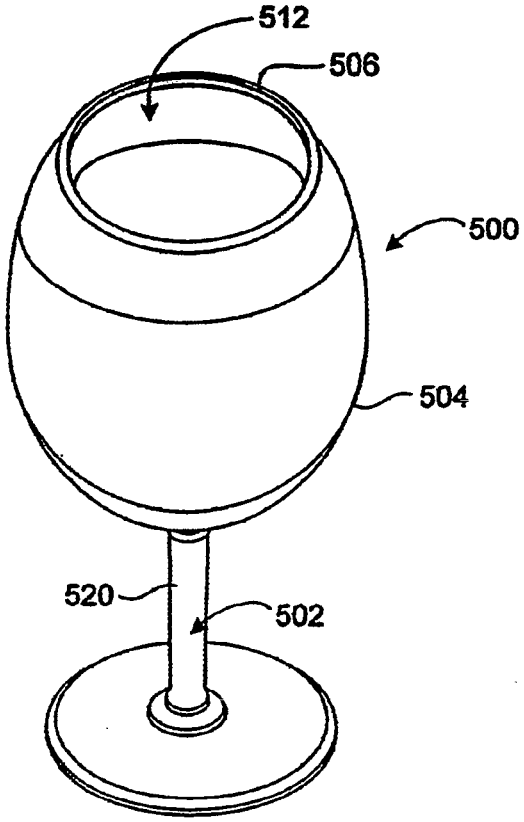
Figure 30:
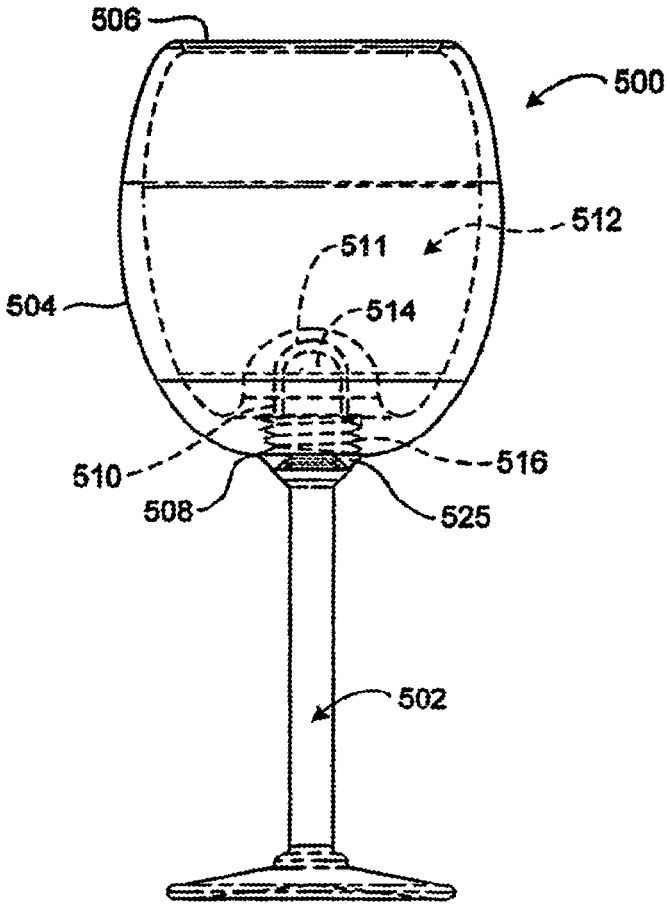
Figure 31:
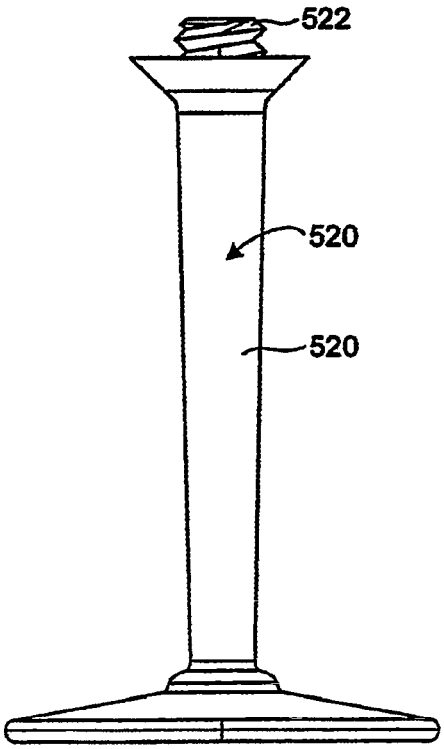

FIGS. 29–31 illustrate another embodiment of a beverage container 500 will be described. Container 500 comprises a base 502 and a vessel 504 having an open top end 506 and a closed bottom end 508 to permit vessel 504 to hold a beverage. Formed in bottom end 508 is a cavity 510 that extends up into an interior 512 of vessel 504. Cavity 510 is cylindrical in geometry at its base and hemispherical at its top to receive a cooling element 514 (see FIG. 30) that is similar to cooling element 214 in other embodiments. The bottom of cavity 510 has threads 516 for receiving corresponding threads cooling element 514.

Cavity 510 has a top 511 that is curved or rounded to maximize the amount of heating or cooling area in contact with the beverage. However, it will be appreciated that other shapes could be used as well. For example, it could be stepped, square, rectangular, pyramid shaped or the like. When element 514 is screwed into cavity 510, the top end of element 514 comes into contact with the top end 511 of cavity 510 to maximize heat transfer in a manner similar to that described with other embodiments. Also, additional support material may be included in the region where the outer walls of vessel 504 intersect cavity 510. In this way, vessel 504 is made more durable so that it will resist breaking when connection to base 502.

One particular feature of cooling element 514 is that it also functions as a connector to connect vessel 504 to base 502. More specifically, base 502 includes a stem 520 (see FIG. 31) having a threaded top end 522. Element 514 also includes threads at its bottom end for receiving the threaded top end 522 of base 502. As best shown in FIG. 29, this arrangement permits vessel 504 to be coupled to base 502 without coming into contact with each other. This allows vessel 504 and base 502 to be constructed of relatively fragile materials, such as glass, ceramics, porcelain, china, and the like, and then connected to each other using a softer material as a connector. For example, connector 514 may be constructed of a plastic, acrylic, or the like. In this way, the more fragile materials used to construct base 502 and vessel 504 may be screwed into connector 514 without breaking. Also, connector 514 accommodates expansion and contraction of the other pieces during heating or cooling. In some cases, the entire beverage container could be constructed of the same material, such as plastic, acrylic or the like. One exemplary material for constructing connector 514 is an acrylic material having a durometer in the range from about 30 to about 40, and more preferably about 35. Such a material has a small coefficient of thermal expansion so that it does not excessively shrink or expand due to changes in temperature. Further, the material is hard enough so that a stable connection is provided between base 502 and vessel 504. At the same time, the material is soft enough to prevent breakage of the vessel 504 or the base 502.

Connector 514 also includes a tapered end 525 (see FIG. 30) that serves as a buffer between base 502 and vessel 504 so that the two pieces never come into direct contact. This also helps to prevent base 502 and vessel 504 from breaking. Conveniently, the taper of end 525 matches the angle of vessel 504 so that a smooth, continuous surface is provided along the exterior of container 500.

Another important feature of container 500 is that it takes about a half a turn to insert and remove connector 514 and to connect and remove base 502 to and from connector 514 similar to other embodiments. However, the pitch may be configured so that the pieces separate when turned about ¼ turn to about one turn or more.

The invention has now been described in detail for purposes of clarity and understanding. However, it will be appreciated that certain changes and modifications may be practiced within the scope of the appended claims.

What is claimed is:

1. A beverage container, comprising:

a vessel having an interior that is adapted to hold a beverage, wherein the vessel has a closed bottom end and an open top end, and wherein the bottom end defines a cavity that is fluidly sealed from the interior of the vessel;

a cooling element that is configured to be coupled to the vessel and to fit within the cavity; and a base comprising a bottom member and a stem extending vertically upward from the bottom member, wherein the base includes a connector that is configured to be coupled to the cooling element.

2. A container as in claim 1, wherein the connector comprises a threaded end on the stem, wherein the cooling element includes a threaded section, and wherein the threaded end on the stem is configured to be screwed into the threaded section of the cooling element.

3. A container as in claim 2, wherein the threaded section of the cooling element has threads, and wherein an angle defined by the threads is about 65 degrees to about 75 degrees.

4. A container as in claim 2, wherein the cooling element also includes a threaded section, wherein the vessel includes a threaded section at the bottom end, and wherein the threaded section of the cooling element is configured to be screwed into the threaded section of the vessel.

5. A container as in claim 4, wherein the threaded section of the cooling element has threads, and wherein an angle defined by the threads is about 45 degrees to about 90 degrees.

6. A container as in claim 4, wherein the base and the vessel are constructed of glass, and wherein the cooling element is constructed of a material that is different from glass.

7. A container as in claim 6, wherein the cooling element is constructed of an acrylic.

8. A container as in claim 7, wherein the acrylic has a durometer of about 30 to about 40.

9. A container as in claim 2, wherein the cooling element has a bottom end and a top end, and wherein the bottom end tapers inward and mates with a mating taper on the base.

10. A container as in claim 9, wherein the top end of the cooling element is generally hemispherical in geometry.

11. A container as in claim 10, wherein the bottom end of the vessel includes a generally hemispherical surface that partially defines the interior of the vessel.

12. A container as in claim 1, wherein the base and the vessel are constructed of a material selected from a group consisting of glass, plastics and acrylics.

13. A container as in claim 1, wherein the vessel has a shape selected from a group consisting of a mug, a regular wine glass, a red wine glass, a white wine glass, a martini glass, a tumbler, a stein glass, a margarita glass, a brandy snifter, a water glass, a beer glass and a champagne glass.

14. A beverage container kit comprising:

a vessel having an interior that is adapted to hold a beverage, wherein the vessel has a closed bottom end and an open top end, and wherein the bottom end defines a cavity that is fluidly sealed from the interior of the vessel;

a cooling element that is configured to be coupled to the vessel and to fit within the cavity;

a base comprising a bottom member and a stem extending vertically upward from the bottom member, wherein the base includes a connector that is configured to be coupled to the cooling element; and a tray having a plurality of holding regions for holding cooling elements, whereby the tray may be placed in a freezer to cool the cooling elements.

15. A kit as in claim 14, wherein the tray includes a plurality of recesses integrally formed in the tray to define the holding regions.

16. A kit as in claim 15, wherein the recesses are in a shape selected from a group consisting of semi-cylindrical, ice cube shaped, pyramidal and semi-spherical.

17. A kit as in claim 14, wherein the base further comprises a bottom member and a stem extending vertically upward from the bottom member.

18. A kit as in claim 17, wherein the connector comprises a threaded end on the stem, wherein the cooling element includes a threaded section, and wherein the threaded end on the stem is configured to be screwed into the threaded section of the cooling element.

19. A kit as in claim 18, wherein the cooling element also includes a threaded section, wherein the vessel includes a threaded section at the bottom end, and wherein the threaded section of the cooling element is configured to be screwed into the threaded section of the vessel.

* * * * *

UNITED STATES PATENT AND TRADEMARK OFFICE

CERTIFICATE OF CORRECTION

PATENT NO. : 6,931,885 B2
APPLICATION NO. : 10/712170
DATED : August 23, 2005
INVENTOR(S) : Andrew Citrynell, Kimberly Ann Miller and Joel Schwarze It is certified that error appears in the above-identified patent and that said Letters Patent is hereby corrected as shown below:

Please replace the originally filed drawings with the attached replacement drawings.

Signed and Sealed this

Seventh Day of November, 2006

JON W. DUDAS
*Director of the United States Patent and Trademark Office*

US006931885B2

(12) United States Patent
Citrynell et al.

(10) Patent No.: US 6,931,885 B2
(45) Date of Patent: Aug. 23, 2005

(54) DRINKING VESSELS WITH REMOVABLE COOLING DEVICES

(75) Inventors: Andrew Citrynell, 264 Sunrise La., Carbondale, CO (US) 81623; Kimberly Ann Miller, Carbondale, CO (US); Joel Schwarze, Hutchinson, MN (US)

(73) Assignee: Andrew Citrynell, Carbondale, CO (US)

( * ) Notice: Subject to any disclaimer, the term of this patent is extended or adjusted under 35 U.S.C. 154(b) by 0 days.

(21) Appl. No.: 10/712,170

(22) Filed: Nov. 12, 2003

(65) Prior Publication Data

US 2004/0177642 A1 Sep. 16, 2004

Related U.S. Application Data

(63) Continuation-in-part of application No. 10/389,733, filed on Mar. 14, 2003, now Pat. No. 6,758,058.

(51) Int. Cl.[7] ..... F25D 3/08
(52) U.S. Cl. ..... 62/457.3; 62/530
(58) Field of Search ..... 62/457.3, 457.4, 62/457.1, 530, 371, 438, 529; 220/709, 739

(56) References Cited

U.S. PATENT DOCUMENTS

| | | | |
|---|---|---|---|
| 4,765,393 | A | 8/1988 | Baxter |
| 5,044,173 | A | 9/1991 | Cheng |
| 5,189,892 | A | 3/1993 | Roberts |
| 5,467,877 | A | 11/1995 | Smith |
| 5,597,087 | A | 1/1997 | Vinarsky |
| 6,474,096 | B1 | 11/2002 | de la Guardia |

*Primary Examiner*—Chen Wen Jiang
(74) *Attorney, Agent, or Firm*—Townsend and Townsend and Crew LLP

(57) ABSTRACT

In one embodiment, a beverage container comprises a vessel having an interior that is adapted to hold a beverage. The vessel has a closed bottom end and an open top end. The bottom end defines a cavity that is fluidly sealed from the interior of the vessel. A cooling element is configured to be coupled to the vessel and to fit within the cavity. A base comprises a bottom member and a stem extending vertically upward from the bottom member. The base includes a connector that is configured to be coupled to the cooling element or vice versa.

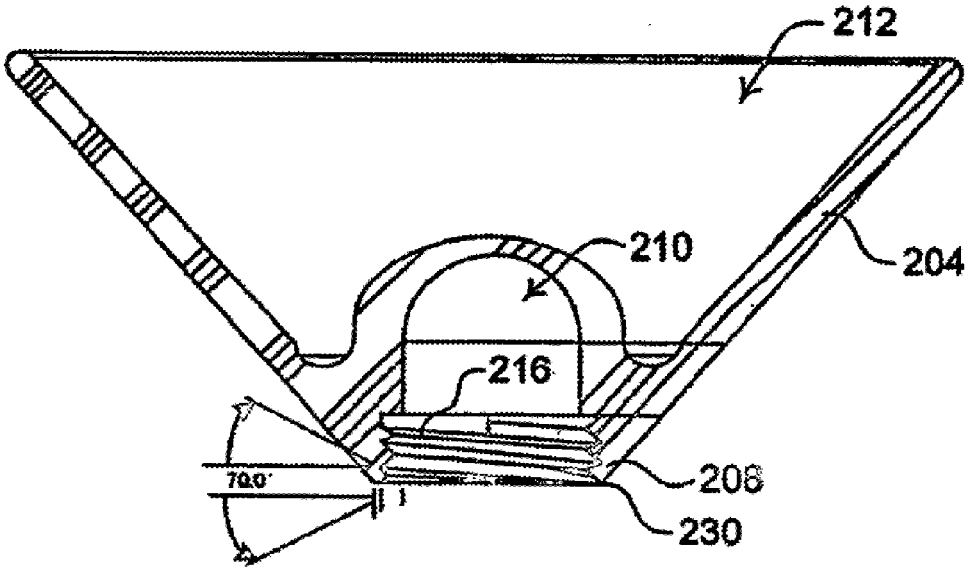

19 Claims, 24 Drawing Sheets